US007784567B2

(12) United States Patent
Choe et al.

(10) Patent No.: US 7,784,567 B2
(45) Date of Patent: Aug. 31, 2010

(54) EARTH-BORING ROTARY DRILL BITS INCLUDING BIT BODIES COMPRISING REINFORCED TITANIUM OR TITANIUM-BASED ALLOY MATRIX MATERIALS, AND METHODS FOR FORMING SUCH BITS

(75) Inventors: Heeman Choe, The Woodlands, TX (US); John H. Stevens, Spring, TX (US); James L. Overstreet, Tomball, TX (US); James C. Westhoff, The Woodlands, TX (US); Jimmy W. Eason, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 301 days.

(21) Appl. No.: 11/593,437

(22) Filed: Nov. 6, 2006

(65) Prior Publication Data

US 2007/0102202 A1 May 10, 2007

Related U.S. Application Data

(63) Continuation-in-part of application No. 11/271,153, filed on Nov. 10, 2005, and a continuation-in-part of application No. 11/272,439, filed on Nov. 10, 2005.

(51) Int. Cl.
*E21B 1/54* (2006.01)

(52) U.S. Cl. ..... 175/374; 175/425

(58) Field of Classification Search ..... 175/425, 175/374

See application file for complete search history.

(56) References Cited

U.S. PATENT DOCUMENTS 2,507,439 A 5/1950 Goolsbee (Continued)

FOREIGN PATENT DOCUMENTS

AU 695583 2/1998

(Continued)

OTHER PUBLICATIONS

Reed, James S., "Chapter 13: Particle Packing Characteristics," Principles of Ceramics Processing, Second Edition, John Wiley & Sons, Inc. (1995), pp. 215-227.

(Continued)

*Primary Examiner*—William P Neuder
*Assistant Examiner*—Nicole A Coy
(74) *Attorney, Agent, or Firm*—TraskerBritt

(57) ABSTRACT

Earth-boring rotary drill bits include bit bodies comprising a composite material including a plurality of hard phase regions or particles dispersed throughout a titanium or titanium-based alloy matrix material. The bits further include a cutting structure disposed on a face of the bit body. In some embodiments, the bit bodies may include a plurality of regions having differing material compositions. For example, the bit bodies may include a first region comprising a plurality of hard phase regions or particles dispersed throughout a titanium or titanium-based alloy matrix material, and a second region comprising a titanium or a titanium-based alloy material. Methods for forming such drill bits include at least partially sintering a plurality of hard particles and a plurality of particles comprising titanium or a titanium-based alloy material to form a bit body comprising a particle-matrix composite material. A shank may be attached directly to the bit body.

18 Claims, 11 Drawing Sheets

U.S. PATENT DOCUMENTS

| | | | | |
|---|---|---|---|---|
| 2,819,958 | A | | 1/1958 | Abkowitz et al. |
| 2,819,959 | A | | 1/1958 | Abkowitz et al. |
| 2,906,654 | A | | 9/1959 | Abkowitz |
| 3,368,881 | A | | 2/1968 | Abkowitz et al. |
| 3,471,921 | A | | 10/1969 | Feenstra |
| 3,660,050 | A | | 5/1972 | Iler et al. |
| 3,757,879 | A | | 9/1973 | Wilder et al. |
| 3,987,859 | A | | 10/1976 | Lichte |
| 4,017,480 | A | | 4/1977 | Baum |
| 4,047,828 | A | | 9/1977 | Makely |
| 4,094,709 | A | | 6/1978 | Rozmus |
| 4,128,136 | A | | 12/1978 | Generoux |
| 4,221,270 | A | | 9/1980 | Vezirian |
| 4,229,638 | A | | 10/1980 | Lichte |
| 4,233,720 | A | | 11/1980 | Rozmus |
| 4,252,202 | A | | 2/1981 | Purser, Sr. |
| 4,255,165 | A | | 3/1981 | Dennis et al. |
| 4,306,139 | A | | 12/1981 | Shinozaki et al. |
| 4,341,557 | A | | 7/1982 | Lizenby |
| 4,389,952 | A | | 6/1983 | Dreier et al. |
| 4,398,952 | A | | 8/1983 | Drake |
| 4,499,048 | A | | 2/1985 | Hanejko |
| 4,499,795 | A | | 2/1985 | Radtke |
| 4,499,958 | A | | 2/1985 | Radtke et al. |
| 4,526,748 | A | | 7/1985 | Rozmus |
| 4,547,337 | A | | 10/1985 | Rozmus |
| 4,552,232 | A | | 11/1985 | Frear |
| 4,554,130 | A | | 11/1985 | Ecer |
| 4,562,990 | A | | 1/1986 | Rose |
| 4,596,694 | A | | 6/1986 | Rozmus |
| 4,597,730 | A | | 7/1986 | Rozmus |
| 4,620,600 | A | | 11/1986 | Persson |
| 4,656,002 | A | | 4/1987 | Lizenby et al. |
| 4,667,756 | A | | 5/1987 | King et al. |
| 4,686,080 | A | | 8/1987 | Hara et al. |
| 4,694,919 | A | | 9/1987 | Barr |
| 4,743,515 | A | | 5/1988 | Fischer et al. |
| 4,744,943 | A | | 5/1988 | Timm |
| 4,809,903 | A | | 3/1989 | Eylon et al. |
| 4,838,366 | A | | 6/1989 | Jones |
| 4,871,377 | A | | 10/1989 | Frushour |
| 4,919,013 | A | | 4/1990 | Smith et al. |
| 4,923,512 | A | | 5/1990 | Timm et al. |
| 4,956,012 | A | | 9/1990 | Jacobs et al. |
| 4,968,348 | A | | 11/1990 | Abkowitz et al. |
| 5,000,273 | A | | 3/1991 | Horton et al. |
| 5,030,598 | A | | 7/1991 | Hsieh |
| 5,032,352 | A | | 7/1991 | Meeks et al. |
| 5,049,450 | A | | 9/1991 | Dorfman et al. |
| 5,068,003 | A | * | 11/1991 | Takahashi et al. ..... 148/421 |
| 5,090,491 | A | | 2/1992 | Tibbitts et al. |
| 5,101,692 | A | | 4/1992 | Simpson |
| 5,150,636 | A | | 9/1992 | Hill |
| 5,161,898 | A | | 11/1992 | Drake |
| 5,232,522 | A | | 8/1993 | Doktycz et al. |
| 5,281,260 | A | | 1/1994 | Kumar et al. |
| 5,286,685 | A | | 2/1994 | Schoennahl et al. |
| 5,348,806 | A | | 9/1994 | Kojo et al. |
| 5,439,068 | A | | 8/1995 | Huffstutler et al. |
| 5,443,337 | A | | 8/1995 | Katayama |
| 5,482,670 | A | | 1/1996 | Hong |
| 5,484,468 | A | | 1/1996 | Ostlund et al. |
| 5,506,055 | A | | 4/1996 | Dorfman et al. |
| 5,543,235 | A | | 8/1996 | Mirchandani et al. |
| 5,560,440 | A | | 10/1996 | Tibbitts |
| 5,593,474 | A | | 1/1997 | Keshavan et al. |
| 5,611,251 | A | | 3/1997 | Katayama |
| 5,612,264 | A | | 3/1997 | Nilsson et al. |
| 5,641,251 | A | | 6/1997 | Leins et al. |
| 5,641,921 | A | | 6/1997 | Dennis et al. |
| 5,662,183 | A | | 9/1997 | Fang |
| 5,677,042 | A | | 10/1997 | Massa et al. |
| 5,679,445 | A | | 10/1997 | Massa et al. |
| 5,697,046 | A | | 12/1997 | Conley |
| 5,732,783 | A | | 3/1998 | Truax et al. |
| 5,733,649 | A | | 3/1998 | Kelley et al. |
| 5,733,664 | A | | 3/1998 | Kelley et al. |
| 5,753,160 | A | | 5/1998 | Takeuchi et al. |
| 5,765,095 | A | | 6/1998 | Flak et al. |
| 5,776,593 | A | | 7/1998 | Massa et al. |
| 5,778,301 | A | | 7/1998 | Hong |
| 5,789,686 | A | | 8/1998 | Massa et al. |
| 5,792,403 | A | | 8/1998 | Massa et al. |
| 5,806,934 | A | | 9/1998 | Massa et al. |
| 5,829,539 | A | | 11/1998 | Newton et al. |
| 5,830,256 | A | | 11/1998 | Northrop et al. |
| 5,856,626 | A | | 1/1999 | Fischer et al. |
| 5,865,571 | A | | 2/1999 | Tankala et al. |
| 5,868,502 | A | * | 2/1999 | Cariveau et al. ..... 384/93 |
| 5,880,382 | A | | 3/1999 | Fang et al. |
| 5,897,830 | A | | 4/1999 | Abkowitz et al. |
| 5,947,214 | A | * | 9/1999 | Tibbitts ..... 175/276 |
| 5,957,006 | A | | 9/1999 | Smith |
| 5,963,775 | A | | 10/1999 | Fang |
| 6,029,544 | A | | 2/2000 | Katayama |
| 6,045,750 | A | | 4/2000 | Drake et al. |
| 6,051,171 | A | | 4/2000 | Takeuchi et al. |
| 6,063,333 | A | | 5/2000 | Dennis |
| 6,086,980 | A | | 7/2000 | Foster et al. |
| 6,089,123 | A | | 7/2000 | Chow et al. |
| 6,099,664 | A | | 8/2000 | Davies et al. |
| 6,148,936 | A | | 11/2000 | Evans et al. |
| 6,200,514 | B1 | | 3/2001 | Meister |
| 6,200,685 | B1 | | 3/2001 | Davidson |
| 6,209,420 | B1 | | 4/2001 | Butcher et al. |
| 6,214,134 | B1 | | 4/2001 | Eylon et al. |
| 6,214,287 | B1 | | 4/2001 | Waldenstrom |
| 6,220,117 | B1 | | 4/2001 | Butcher |
| 6,227,188 | B1 | | 5/2001 | Tankala et al. |
| 6,228,139 | B1 | | 5/2001 | Oskarson |
| 6,241,036 | B1 | | 6/2001 | Lovato et al. |
| 6,254,658 | B1 | | 7/2001 | Taniuchi et al. |
| 6,287,360 | B1 | | 9/2001 | Kembaiyan et al. |
| 6,290,438 | B1 | | 9/2001 | Papajewski |
| 6,293,986 | B1 | | 9/2001 | Rodiger et al. |
| 6,348,110 | B1 | | 2/2002 | Evans |
| 6,375,706 | B2 | | 4/2002 | Kembaiyan et al. |
| 6,454,025 | B1 | | 9/2002 | Runquist et al. |
| 6,454,028 | B1 | | 9/2002 | Evans |
| 6,454,030 | B1 | * | 9/2002 | Findley et al. ..... 175/425 |
| 6,458,471 | B2 | | 10/2002 | Lovato et al. |
| 6,500,226 | B1 | | 12/2002 | Dennis |
| 6,511,265 | B1 | | 1/2003 | Mirchandani et al. |
| 6,576,182 | B1 | | 6/2003 | Ravagni et al. |
| 6,589,640 | B2 | | 7/2003 | Griffin et al. |
| 6,599,467 | B1 | | 7/2003 | Yamaguchi et al. |
| 6,607,693 | B1 | | 8/2003 | Saito et al. |
| 6,655,481 | B2 | | 12/2003 | Findley et al. |
| 6,685,880 | B2 | | 2/2004 | Engstrom et al. |
| 6,742,611 | B1 | | 6/2004 | Illerhaus et al. |
| 6,756,009 | B2 | | 6/2004 | Sim et al. |
| 6,849,231 | B2 | | 2/2005 | Kojima et al. |
| 6,918,942 | B2 | | 7/2005 | Hatta et al. |
| 7,044,243 | B2 | | 5/2006 | Kembaiyan et al. |
| 7,048,081 | B2 | | 5/2006 | Smith et al. |
| 2002/0004105 | A1 | | 1/2002 | Kunze et al. |
| 2003/0010409 | A1 | | 1/2003 | Kunze et al. |
| 2003/0041922 | A1 | | 3/2003 | Hirose et al. |
| 2003/0219605 | A1 | | 11/2003 | Molian et al. |
| 2004/0013558 | A1 | | 1/2004 | Kondoh et al. |
| 2004/0060742 | A1 | | 4/2004 | Kembaiyan et al. |
| 2004/0243241 | A1 | | 12/2004 | Istephanous et al. |
| 2004/0245024 | A1 | | 12/2004 | Kembaiyan |
| 2005/0008524 | A1 | | 1/2005 | Testani |

| | | | | |
|---|---|---|---|---|
| 2005/0072496 | A1 | 4/2005 | Hwang et al. | |
| 2005/0084407 | A1 | 4/2005 | Myrick | |
| 2005/0117984 | A1 | 6/2005 | Eason et al. | |
| 2005/0126334 | A1 | 6/2005 | Mirchandani | |
| 2005/0211475 | A1 | 9/2005 | Mirchandani et al. | |
| 2005/0247491 | A1 | 11/2005 | Mirchandani et al. | |
| 2005/0268746 | A1 | 12/2005 | Abkowitz et al. | |
| 2006/0016521 | A1 | 1/2006 | Hanusiak et al. | |
| 2006/0043648 | A1 | 3/2006 | Takeuchi et al. | |
| 2006/0057017 | A1 | 3/2006 | Woodfield et al. | |
| 2006/0131081 | A1 | 6/2006 | Mirchandani et al. | |
| 2006/0165973 | A1 * | 7/2006 | Dumm et al. | 428/323 |
| 2007/0042217 | A1 | 2/2007 | Fang et al. | |

FOREIGN PATENT DOCUMENTS

| | | | |
|---|---|---|---|
| CA | 2212197 | | 10/2000 |
| EP | 0 453 428 | A1 | 10/1991 |
| EP | 0 995 876 | A2 | 4/2000 |
| EP | 1 244 531 | B1 | 10/2002 |
| GB | 945227 | | 12/1963 |
| GB | 2203774 | A | 10/1988 |
| GB | 2 385 350 | A | 8/2003 |
| GB | 2 393 449 | A | 3/2004 |
| JP | 10 219385 | A | 8/1998 |
| WO | WO 03/049889 | A2 | 6/2003 |

OTHER PUBLICATIONS

PCT International Search Report for counterpart PCT International Application No. PCT/US2007/023275, mailed Apr. 11, 2008.

U.S. Appl. No. 60/566,063, filed Apr. 28, 2004, entitled "Body Materials for Earth Boring Bits" to Mirchandani et al.

Alman, D.E., et al., "The Abrasive Wear of Sintered Titanium Matrix-Ceramic Particle Reinforced Composites," WEAR, 225-229 (1999), pp. 629-639.

"Boron Carbide Nozzles and Inserts," Seven Stars International webpage http://www.concetric.net/~ctkang/nozzle.shtml, printed Sep. 7, 2006.

Choe, Heeman, et al., "Effect of Tungsten Additions on the Mechanical Properties of Ti-6A1-4V," Material Science and Engineering, A 396 (2005), pp. 99-106, Elsevier.

Diamond Innovations, "Composite Diamond Coatings, Superhard Protection of Wear Parts New Coating and Service Parts from Diamond Innovations" brochure, 2004.

Gale, W.F., et al., Smithells Metals Reference Book, Eighth Edition, 2003, p. 2117, Elsevier Butterworth Heinemann.

"Heat Treating of Titanium and Titanium Alloys," Key to Metals website article, www.key-to-metals.com, printed Sep. 21, 2006.

Miserez, A., et al. "Particle Reinforced Metals of High Ceramic Content," Material Science and Engineering A 387-389 (2004), pp. 822-831, Elsevier.

Warrier, S.G., et al., "Infiltration of Titanium Alloy-Matrix Composites," Journal of Materials Science Letters, 12 (1993), pp. 865-868, Chapman & Hall.

U.S. Appl. No. 11/271,153, filed Nov. 10, 2005, entitled "Earth-Boring Rotary Drill Bits and Methods of Forming Earth-Boring Rotary Drill Bits" to Oxford et al.

U.S. Appl. No. 11/272,439, filed Nov. 10, 2005, entitled "Earth-Boring Rotary Drill Bits and Methods of Manufacturing Earth-Boring Rotary Drill Bits Having Particle-Matrix Composite Bit Bodies" to Smith et al.

U.S. Appl. No. 11/540,912, filed Sep. 29, 2006, entitled "Earth-Boring Rotary Drill Bits Including Bit Bodies Having Boron Carbide Particles in Aluminum or Aluminum-Based Alloy Matrix Materials, and Methods for Forming Such Bits" to Choe et al.

US 4,966,627, 10/1990, Keshavan et al. (withdrawn)

* cited by examiner

EARTH-BORING ROTARY DRILL BITS INCLUDING BIT BODIES COMPRISING REINFORCED TITANIUM OR TITANIUM-BASED ALLOY MATRIX MATERIALS, AND METHODS FOR FORMING SUCH BITS

CROSS-REFERENCE TO RELATED APPLICATIONS

This application is a continuation-in-part of application Ser. No. 11/271,153, filed Nov. 10, 2005, pending, the disclosure of which is incorporated herein in its entirety by this reference. This application is also a continuation-in-part of application Ser. No. 11/272,439, filed Nov. 10, 2005, pending, the disclosure of which is also incorporated herein in its entirety by this reference.

BACKGROUND OF THE INVENTION

1. Field of the Invention

The present invention generally relates to earth-boring rotary drill bits, and to methods of manufacturing such earth-boring rotary drill bits. More particularly, the present invention generally relates to earth-boring rotary drill bits that include a bit body having at least a portion thereof substantially formed of a particle-matrix composite material, and to methods of manufacturing such earth-boring rotary drill bits.

2. State of the Art

Rotary drill bits are commonly used for drilling bore holes, or well bores, in earth formations. Rotary drill bits include two primary configurations. One configuration is the roller cone bit, which conventionally includes three roller cones mounted on support legs that extend from a bit body. Each roller cone is configured to spin or rotate on a support leg. Teeth are provided on the outer surfaces of each roller cone for cutting rock and other earth formations. The teeth often are coated with an abrasive, hard ("hardfacing") material. Such materials often include tungsten carbide particles dispersed throughout a metal alloy matrix material. Alternatively, receptacles are provided on the outer surfaces of each roller cone into which hard metal inserts are secured to form the cutting elements. In some instances, these inserts comprise a superabrasive material formed on and bonded to a metallic substrate. The roller cone drill bit may be placed in a bore hole such that the roller cones abut against the earth formation to be drilled. As the drill bit is rotated under applied weight on bit, the roller cones roll across the surface of the formation, and the teeth crush the underlying formation.

A second primary configuration of a rotary drill bit is the fixed-cutter bit (often referred to as a "drag" bit), which conventionally includes a plurality of cutting elements secured to a face region of a bit body. Generally, the cutting elements of a fixed-cutter type drill bit have either a disk shape or a substantially cylindrical shape. A hard, superabrasive material, such as mutually bonded particles of polycrystalline diamond, maybe provided on a substantially circular end surface of each cutting element to provide a cutting surface. Such cutting elements are often referred to as "polycrystalline diamond compact" (PDC) cutters. The cutting elements may be fabricated separately from the bit body and are secured within pockets formed in the outer surface of the bit body. A bonding material such as an adhesive or a braze alloy may be used to secure the cutting elements to the bit body. The fixed-cutter drill bit may be placed in a bore hole such that the cutting elements abut against the earth formation to be drilled. As the drill bit is rotated, the cutting elements scrape across and shear away the surface of the underlying formation.

The bit body of a rotary drill bit of either primary configuration may be secured, as is conventional, to a hardened steel shank having an American Petroleum Institute (API) threaded pin for attaching the drill bit to a drill string. The drill string includes tubular pipe and equipment segments coupled end to end between the drill bit and other drilling equipment at the surface. Equipment such as a rotary table or top drive may be used for rotating the drill string and the drill bit within the bore hole. Alternatively, the shank of the drill bit may be coupled directly to the drive shaft of a down-hole motor, which then may be used to rotate the drill bit.

The bit body of a rotary drill bit may be formed from steel. Alternatively, the bit body may be formed from a particle-matrix composite material. Such particle-matrix composite materials conventionally include hard tungsten carbide particles randomly dispersed throughout a copper or copper-based alloy matrix material (often referred to as a "binder" material). Such bit bodies conventionally are formed by embedding a steel blank in tungsten carbide particulate material within a mold, and infiltrating the particulate tungsten carbide material with molten copper or copper-based alloy material. Drill bits that have bit bodies formed from such particle-matrix composite materials may exhibit increased erosion and wear resistance, but lower strength and toughness, relative to drill bits having steel bit bodies.

As subterranean drilling conditions and requirements become ever more rigorous, there arises a need in the art for novel particle-matrix composite materials for use in bit bodies of rotary drill bits that exhibit enhanced physical properties and that may be used to improve the performance of earth-boring rotary drill bits.

BRIEF SUMMARY OF THE INVENTION

In one embodiment, the present invention includes an earth-boring rotary drill bit for drilling a subterranean formation. The drill bit includes a bit body comprising a particle-matrix composite material having a plurality of hard particles or regions dispersed throughout a titanium or titanium-based alloy matrix material. The drill bit further includes at least one cutting structure on a face of the bit body.

In another embodiment, the present invention includes an earth-boring rotary drill bit comprising a bit body having a plurality of regions having differing material compositions. For example, the bit body of the drill bit may include a first region having a first material composition and a second region having a second material composition that differs from the first material composition. The first material composition may include a plurality of hard particles or regions dispersed throughout a titanium or titanium-based alloy matrix material, and the second material composition may comprise a titanium or a titanium-based alloy material. Furthermore, a plurality of cutting structures may be disposed on a surface of the bit body.

In yet another embodiment, the present invention includes a method of forming an earth-boring rotary drill bit. The method includes providing a green powder component comprising a plurality of hard particles and a plurality of particles comprising titanium or a titanium-based alloy material, and at least partially sintering the green powder component to form a bit body comprising a particle-matrix composite material. A shank configured for attachment to a drill string may be attached directly to the bit body.

The features, advantages, and additional aspects of the present invention will be apparent to those skilled in the art from a consideration of the following detailed description considered in combination with the accompanying drawings.

BRIEF DESCRIPTION OF THE SEVERAL VIEWS OF THE DRAWINGS

While the specification concludes with claims particularly pointing out and distinctly claiming that which is regarded as the present invention, the advantages of this invention may be more readily ascertained from the following description of the invention when read in conjunction with the accompanying drawings in which:

DETAILED DESCRIPTION OF THE INVENTION

The illustrations presented herein are not meant to be actual views of any particular material, apparatus, or method, but are merely idealized representations which are employed to describe the present invention. Additionally, elements common between figures may retain the same numerical designation.

The term "green" as used herein means unsintered.

The term "green bit body" as used herein means an unsintered structure comprising a plurality of discrete particles held together by a binder material, the structure having a size and shape allowing the formation of a bit body suitable for use in an earth-boring drill bit from the structure by subsequent manufacturing processes including, but not limited to, machining and densification.

The term "brown" as used herein means partially sintered.

The term "brown bit body" as used herein means a partially sintered structure comprising a plurality of particles, at least some of which have partially grown together to provide at least partial bonding between adjacent particles, the structure having a size and shape allowing the formation of a bit body suitable for use in an earth-boring drill bit from the structure by subsequent manufacturing processes including, but not limited to, machining and further densification. Brown bit bodies may be formed by, for example, partially sintering a green bit body.

As used herein, the term "material composition" means the chemical composition and microstructure of a material. In other words, materials having the same chemical composition but a different microstructure are considered to have different material compositions.

The term "sintering" as used herein means densification of a particulate component involving removal of at least a portion of the pores between the starting particles (accompanied by shrinkage) combined with coalescence and bonding between adjacent particles.

Figure 1:
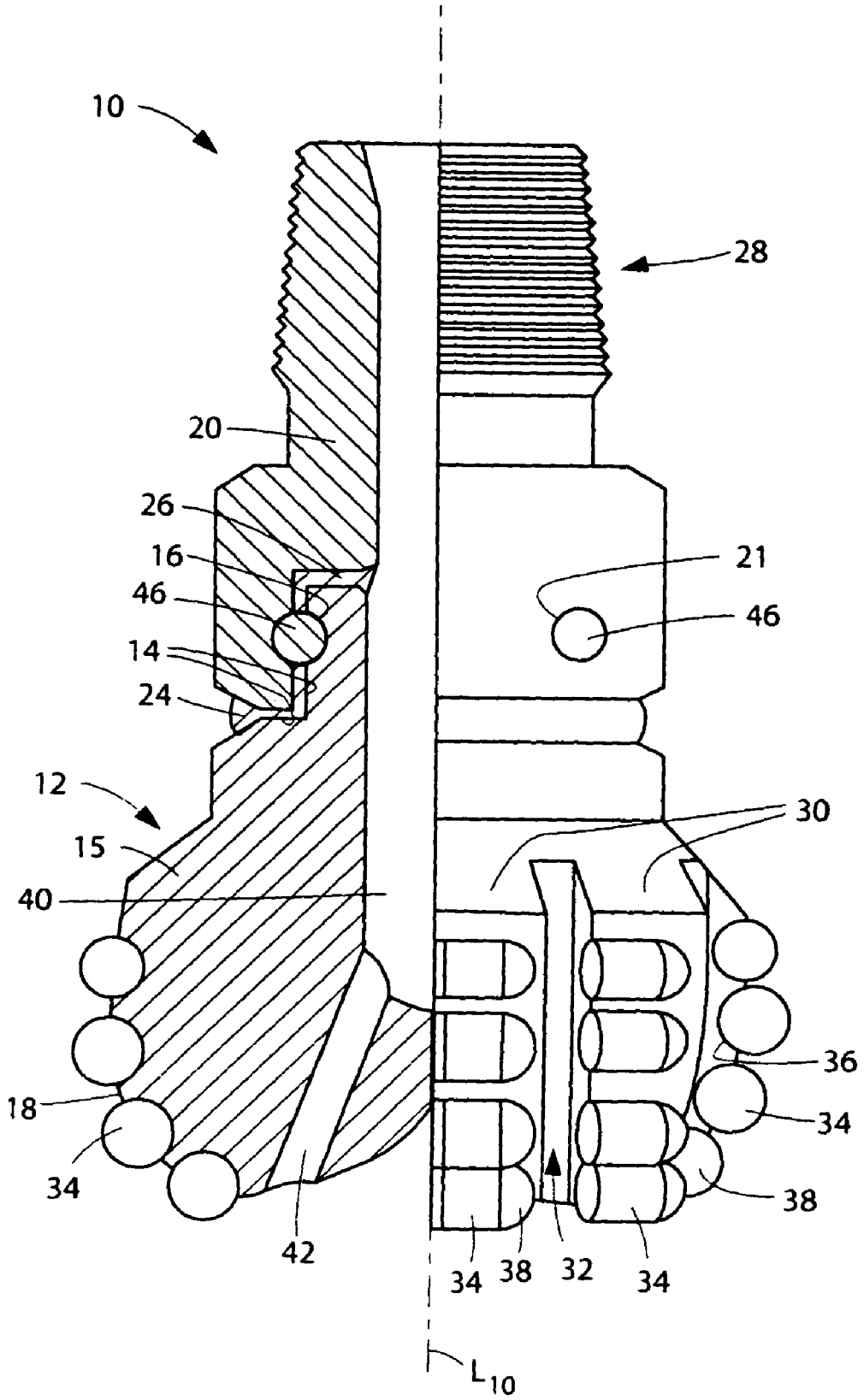
FIG. 1 is a partial cross-sectional side view of an earth-boring rotary drill bit that embodies teachings of the present invention and includes a bit body comprising a particle-matrix composite material.

An earth-boring rotary drill bit 10 that embodies teachings of the present invention is shown in FIG. 1. The drill bit 10 includes a bit body 12 comprising a particle-matrix composite material 15 that includes a plurality of hard phase particles or regions dispersed throughout a titanium or a titanium-based alloy matrix material. The hard phase particles or regions are "hard" in the sense that they are relatively harder than the surrounding titanium or a titanium-based alloy matrix material. In some embodiments, the bit body 12 may be predominantly comprised of the particle-matrix composite material 15, which is described in further detail below. The bit body 12 may be fastened to a metal shank 20, which may be formed from steel and may include an American Petroleum Institute (API) threaded pin 28 for attaching the drill bit 10 to a drill string (not shown). The bit body 12 may be secured directly to the shank 20 by, for example, using one or more retaining members 46 in conjunction with brazing and/or welding, as discussed in further detail below.

As shown in FIG. 1, the bit body 12 may include wings or blades 30 that are separated from one another by junk slots 32. Internal fluid passageways 42 may extend between the face 18 of the bit body 12 and a longitudinal bore 40, which extends through the steel shank 20 and at least partially through the bit body 12. In some embodiments, nozzle inserts (not shown) may be provided at the face 18 of the bit body 12 within the internal fluid passageways 42.

The drill bit 10 may include a plurality of cutting structures on the face 18 thereof. By way of example and not limitation, a plurality of polycrystalline diamond compact (PDC) cutters 34 may be provided on each of the blades 30, as shown in FIG. 1. The PDC cutters 34 may be provided along the blades 30 within pockets 36 formed in the face 18 of the bit body 12, and may be supported from behind by buttresses 38, which may be integrally formed with the bit body 12.

The particle-matrix composite material 15 of the bit body 12 may include a plurality of hard phase regions or particles dispersed throughout a titanium or a titanium-based alloy matrix material. By way of example and not limitation, the hard phase regions may be formed from a plurality of hard particles, and may comprise between about 20% and about 60% by volume of the particle-matrix composite material 15, and the matrix material may comprise between about 80% and about 40% by volume of the particle-matrix composite material 15.

In some embodiments, the particle-matrix composite material 15 of the bit body 12 may comprise a ceramic-metal composite material (i.e., a "cermet" material). In other words, the hard phase regions or particles may comprise a ceramic material.

Titanium has two allotropic phases: a hexagonal close-packed $\alpha$ phase and a body-centered cubic $\beta$ phase. In commercially pure titanium, the $\alpha$ phase is stable at temperatures below about 882° C., while the $\beta$ phase is stable at temperatures between about 882° C. and the melting point of about 1668° C. of commercially pure titanium. Various elements have been identified that may be dissolved in titanium to form a solid solution and that can affect the stability of either the $\alpha$ phase or the β phase. Elements that stabilize the a phase are referred to in the art as α stabilizers, while elements that stabilize the β phase are referred to in the art as β stabilizers. For example, aluminum, gallium, oxygen, nitrogen, and carbon have been identified as α stabilizers, and vanadium, molybdenum, niobium, iron, chromium, and nickel have been identified as β stabilizers. Some elements, including tin and zinc for example, enter into solid solution with titanium do not significantly stabilize either the α phase or the β phase. These elements may be referred to as neutral alloying elements.

Various titanium-based alloys may be prepared that include one or more α stabilizers, one or more β stabilizers, and/or one or more neutral alloying elements. These titanium-based alloys are conventionally categorized as either alpha (α) alloys, near alpha (α) alloys, metastable beta (β) alloys, beta (β) alloys, α+β alloys, or titanium aluminides. Alpha alloys are single-phase alloys that are solid solution strengthened by the addition of α stabilizers and/or neutral alloying elements. Near alpha alloys include small amounts (conventionally between about 1 and about 2 atomic percent (At. %)) of β stabilizers. Near alpha alloys may include primarily α phase (alpha alloy) with some retained β phase (beta alloy or metastable beta alloy) in the final microstructure. Metastable beta alloys conventionally include between about 10 and about 15 atomic percent β stabilizers and predominantly comprise metastable (non-equilibrium) β phase at room temperature. Beta alloys include sufficient amounts of β stabilizers (e.g., about 30 atomic percent) so as to render the β phase stable at room temperature. α+β alloys include significant amounts of both the a phase and the β phase (e.g., the α phase and the β phase comprise at least about 10% by volume of the alloy). Titanium aluminides are based on the intermetallic compounds $Ti_3Al$ (often referred to as the $\alpha_2$ phase) and TiAl (often referred to as the γ phase).

In some embodiments of the present invention, the titanium or titanium-based matrix material may include an α+β titanium alloy. For example, the titanium or titanium-based matrix material may include at least about 87.5 weight percent titanium, approximately 6.0 weight percent aluminum, and approximately 4.0 weight percent vanadium (such alloys are often referred to in the art as Ti-6Al-4V or Ti-64 alloys). Such titanium-based alloys may further include at least trace amounts of at least one of tin, copper, iron, and carbon. In some embodiments, the titanium or titanium-based matrix material may include about 89.0 weight percent titanium (e.g., between about 88.0 weight percent and about 90.0 weight percent), about 6.0 weight percent aluminum, and about 4.0 weight percent vanadium.

Table 1 below sets forth various examples of compositions of α+β titanium alloys that may be used as the matrix material in the particle-matrix composite material 15 of the bit body 12 shown in FIG. 1.

TABLE 1

α + β Alloys

| Example | Approximate Elemental Atomic Percent | | | | | | | |
|---|---|---|---|---|---|---|---|---|
| No. | Al | V | Mo | Zr | Sn | Si | Fe | Ti |
| 1 | 6.0 | 4.0 | — | — | — | — | — | Balance |
| 2 | 6.0 | 6.0 | — | — | 2.0 | — | 0.7 | Balance |
| 3 | 4.0 | — | 4.0 | — | 2.0 | 0.5 | — | Balance |
| 4 | 2.25 | — | 4.0 | — | 11.0 | 0.2 | — | Balance |
| 5 | 6.0 | — | 6.0 | 4.0 | 2.0 | — | — | Balance |

In additional embodiments of the present invention, the titanium or titanium-based matrix material may include a beta (β) titanium alloy or a metastable beta (β) titanium alloy. Table 2 below sets forth various examples of compositions of beta (β) titanium alloys that maybe used as the matrix material in the particle-matrix composite material 15 of the bit body 12 shown in FIG. 1, and Table 3 below sets forth various compositions of metastable beta (β) titanium alloys that may be used as the material in the particle-matrix composite material 15 of the bit body 12 shown in FIG. 1.

TABLE 2

Beta (β) Alloys

| Example | Approximate Elemental Atomic Percent | | | | | | | | | |
|---|---|---|---|---|---|---|---|---|---|---|
| No. | Al | Nb | V | Mo | Zr | Sn | Si | Cr | Fe | Ti |
| 6 | 1.5 | — | — | 6.8 | — | — | — | — | 4.5 | Balance |
| 7 | 3.0 | — | 10.0 | — | — | — | — | — | 2.0 | Balance |
| 8 | — | — | — | 11.5 | 6.0 | 4.5 | — | — | — | Balance |
| 9 | 3.0 | 2.6 | — | 15.0 | — | — | 0.2 | — | — | Balance |

TABLE 3

Metastable Beta (β) Alloys

| Example | Approximate Elemental Atomic Percent | | | | | | | | | | |
|---|---|---|---|---|---|---|---|---|---|---|---|
| No. | Al | Nb | V | Mo | Zr | Sn | Si | Cr | Fe | W | Ti |
| 10 | — | — | 35.0 | — | — | — | — | 15.0 | — | — | Balance |
| 11 | — | — | — | 40.0 | — | — | — | — | — | — | Balance |
| 12 | — | — | — | 30.0 | — | — | — | — | — | — | Balance |
| 13 | — | — | — | — | — | — | — | — | — | 30 | Balance |

In yet additional embodiments of the present invention, at least a portion of the bit body 12 may comprise a titanium or titanium-based matrix material that includes an alpha (α) titanium alloy. Table 4 below sets forth various examples of compositions of alpha (α) titanium alloys (including near alpha (α) titanium alloys) that may be used as the matrix material in the particle-matrix composite material 15 of at least a portion of the bit body 12 shown in FIG. 1.

TABLE 4

Alpha (α) Alloys

| Example | Approximate Elemental Atomic Percent | | | | | | | | | |
|---|---|---|---|---|---|---|---|---|---|---|
| No. | Al | Nb | V | Mo | Zr | Sn | Si | Pd | C | Ti |
| 14 | — | — | — | — | — | — | — | 0.2 | — | Balance |
| 15 | 5.0 | — | — | — | — | 2.5 | — | — | — | Balance |
| 16 | 8.0 | — | 1.0 | 1.0 | — | — | — | — | — | Balance |
| 17 | 6.0 | — | — | 2.0 | 4.0 | 2.0 | — | — | — | Balance |
| 18 | 2.25 | — | — | 1.0 | 5.0 | 11.0 | — | — | — | Balance |
| 19 | 6.0 | — | — | 0.5 | 5.0 | — | 0.25 | — | — | Balance |
| 20 | 6.0 | 0.7 | — | 0.5 | 3.5 | 4.0 | 0.35 | — | 0.06 | Balance |

Titanium-based alloys, similar to the examples set forth in Tables 1-4, are capable of exhibiting ultimate tensile strengths in excess of 1,000 megapascals (MPa), fracture toughnesses of greater than about 100 megapascals-square root meter ($MPa\text{-}m^{1/2}$), and hardnesses of greater than about 350 on the Vickers Hardness Scale.

Any titanium-based alloy (in addition to those alloys set forth as examples in Tables 1-4 may be used as matrix material in the particle-matrix composite material 15 of bit bodies that embody teachings of the present invention (such as, for example, the bit body 12 of the drill bit 10 shown in FIG. 1).

In some embodiments, at least a portion of the matrix material of the particle-matrix composite material 15 may be thermally processed (i.e., heat treated) to refine or tailor the microstructure of the matrix material and impart one or more desired physical properties (i.e., increased strength, hardness, fracture toughness, etc.) to the matrix material (and, hence, the particle-matrix composite material 15), as necessary or desired. By way of example and not limitation, at least a portion of the titanium or titanium-based alloy matrix material may be in an annealed condition. By annealing the titanium or titanium-based alloy matrix material, the fracture toughness of the particle-matrix composite material 15 may be increased or otherwise selectively tailored. As another example, at least a portion of the titanium or titanium-based alloy matrix material may be in a solution-treated (ST) condition or a solution-treated and aged (STA) condition. By solution treating and aging the titanium or titanium-based alloy matrix material, the strength of the particle-matrix composite material 15 may be increased or otherwise selectively tailored. Due to the relative stability of the hard phase (e.g., a ceramic phase), these thermal processing techniques generally may be carried out on the titanium or titanium-based alloy matrix material of the particle-matrix composite material 15 without adversely affecting the hard phase of the particle-matrix composite material 15 and/or the surrounding interfacial region between the hard phase and the metal phase of the particle-matrix composite material 15.

The hard phase regions of the particle-matrix composite material 15 may include a plurality of at least one of titanium carbide (TiC) particles, titanium diboride ($TiB_2$) particles, and tungsten (W) particles. By way of example and not limitation, the hard phase regions may comprise between about 20% by volume and about 60% by volume of the particle-matrix composite material 15. In additional embodiments, the hard phase regions may comprise particles of titanium silicide (e.g., $Ti_5Si_3$ and/or $Ti_3Si$), which may be formed by, for example, the decomposition of silicon nitride ($Si_3N_4$) particles during sintering and/or annealing of the particle-matrix composite material 15. In addition to those specifically recited herein, any hard phase regions that increase the wear resistance of the particle-matrix composite material 15 and are chemically compatible with the matrix material may be used in embodiments of the present invention.

In some embodiments, the hard phase regions may have different sizes. Furthermore, in some embodiments, the plurality of hard phase regions may include or exhibit a multi-modal particle size distribution (e.g., bi-modal, tri-modal, tetra-modal, penta-modal, etc.), while in other embodiments, the hard phase regions may have a substantially uniform particle size. By way of example and not limitation, the plurality of hard phase regions may include a plurality of −20 ASTM (American Society for Testing and Materials) Mesh hard phase regions. As used herein, the phrase "−20 ASTM mesh particles" means particles that pass through an ASTM No. 20 U.S.A. standard testing sieve as defined in ASTM Specification E11-04, which is entitled Standard Specification for Wire Cloth and Sieves for Testing Purposes.

Each of the hard phase regions may have a three-dimensional shape that is generally spherical, rectangular, cubic, pentagonal, hexagonal, etc. Furthermore, in some embodiments, each hard phase region may comprise a single crystal.

With continued reference to FIG. 1, at least a portion of the exterior surface of the bit body 12 may be coated with a wear-resistant coating (not shown). By way of example and not limitation, the wear-resistant coating may comprise a layer of titanium nitride formed on or in exposed surfaces of at least the titanium or titanium-based alloy matrix material of the particle-matrix composite material 15. The layer of titanium nitride may be formed on or in exposed surfaces of the particle-matrix composite material 15 that are configured to engage a formation being drilled by the drill bit 10. In additional embodiments, the wear-resistant coating may comprise titanium diboride, or any other material configured to enhance the wear-resistance of the particle-matrix composite material 15. Furthermore, the wear-resistant coating may be strategically placed on various regions of exposed surfaces of the bit body so as to protect regions of the particle-matrix composite material 15 that may be subjected to relatively greater wear during drilling. For example, the face 18 of the bit body 12 (e.g., the formation-engaging surfaces of the blades 30) may be at least partially covered or otherwise provided with a coating or layer of titanium nitride or other wear-resistant material. In particular, surfaces of the blades 30 between adjacent cutters 34 and surfaces of the blades 30 rotationally behind the cutters 34 may be at least partially covered or otherwise provided with a coating or layer of titanium nitride or other wear-resistant material.

During drilling operations, the drill bit 10 may be positioned at the bottom of a well bore and rotated while drilling fluid is pumped to the face 18 of the bit body 12 through the longitudinal bore 40 and the internal fluid passageways 42. As the PDC cutters 34 shear or scrape away the underlying earth formation, the formation cuttings and detritus are mixed with and suspended within the drilling fluid, which passes through the junk slots 32 and the annular space between the well bore hole and the drill string to the surface of the earth formation.

Figure 2:
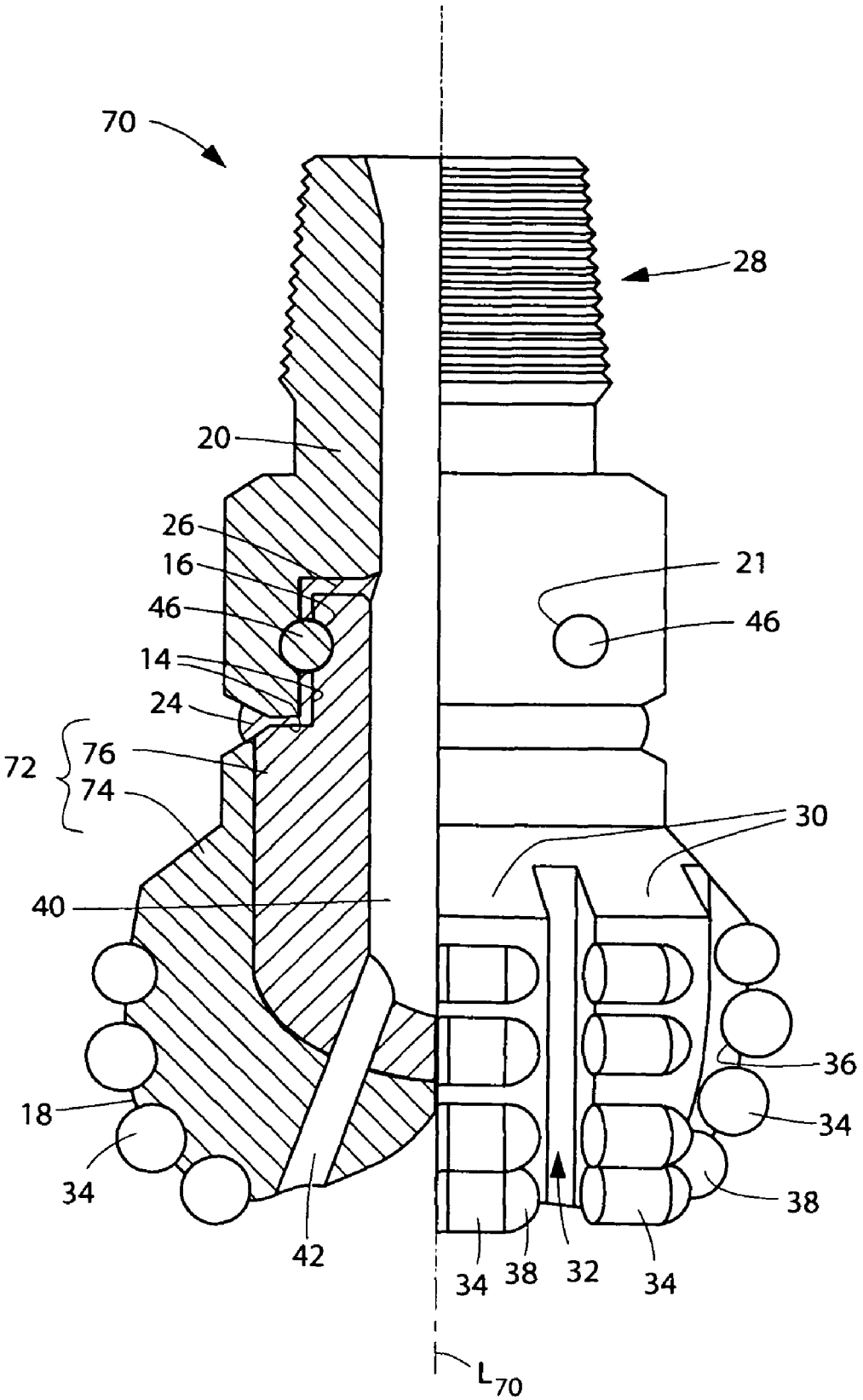
FIG. 2 is a partial cross-sectional side view of another earth-boring rotary drill bit that embodies teachings of the present invention and includes a bit body comprising a particle-matrix composite material.

Another earth-boring rotary drill bit 70 that embodies teachings of the present invention is shown in FIG. 2. The rotary drill bit 70 is generally similar to the previously described rotary drill bit 10 and has a bit body 72 that includes a particle-matrix composite material comprising a plurality of hard phase regions or particles dispersed throughout a titanium or a titanium-based alloy matrix material. The drill bit 70 may also include a shank 20 attached directly to the bit body 72. The shank 20 includes a generally cylindrical outer wall having an outer surface and an inner surface. The outer wall of the shank 20 encloses at least a portion of a longitudinal bore 40 that extends through the drill bit 70. At least one surface of the outer wall of the shank 20 may be configured for attachment of the shank 20 to the bit body 72. The shank 20 also may include a male or female API threaded connection portion 28 for attaching the drill bit 70 to a drill string (not shown). One or more apertures 21 may extend through the outer wall of the shank 20. These apertures are described in greater detail below.

The bit body 72 of the drill bit 70 includes a plurality of regions having different material compositions. By way of example and not limitation, the bit body 72 may include a first region 74 having a first material composition and a second region 76 having a second, different material composition. The first region 74 may include the longitudinally lower and laterally outward regions of the bit body 72 (e.g., the crown region of the bit body 72). The first region 74 may include the face 18 of the bit body 72, which may be configured to carry a plurality of cutting elements, such as PDC cutters 34. For example, a plurality of pockets 36 and buttresses 38 may be provided in or on the face 18 of the bit body 72 for carrying and supporting the PDC cutters 34. Furthermore, a plurality of blades 30 and junk slots 32 may be provided in the first region 74 of the bit body 72. The second region 76 may include the longitudinally upper and laterally inward regions of the bit body 72. The longitudinal bore 40 may extend at least partially through the second region 76 of the bit body 72.

The second region 76 may include at least one surface 14 that is configured for attachment of the bit body 72 to the shank 20. By way of example and not limitation, at least one groove 16 may be formed in at least one surface 14 of the second region 76 that is configured for attachment of the bit body 72 to the shank 20. Each groove 16 may correspond to and be aligned with an aperture 21 extending through the outer wall of the shank 20. A retaining member 46 may be provided within each aperture 21 in the shank 20 and each groove 16. Mechanical interference between the shank 20, the retaining member 46, and the bit body 72 may prevent longitudinal separation of the bit body 72 from the shank 20, and may prevent rotation of the bit body 72 about a longitudinal axis $L_{70}$ of the rotary drill bit 70 relative to the shank 20.

In some embodiments, the bit body 72 of the rotary drill bit 70 may be predominantly comprised of a particle-matrix composite material. Furthermore, the composition of the particle-matrix composite material may be selectively varied within the bit body 72 to provide various regions within the bit body 72 that have different, custom tailored physical properties or characteristics.

In the embodiment shown in FIG. 2, the rotary drill bit 70 includes two retaining members 46. By way of example and not limitation, each retaining member 46 may include an elongated, cylindrical rod that extends through an aperture 21 in the shank 20 and a groove 16 formed in a surface 14 of the bit body 72.

The mechanical interference between the shank 20, the retaining member 46, and the bit body 72 may also provide a substantially uniform clearance or gap between a surface of the shank 20 and the surfaces 14 in the second region 76 of the bit body 72. By way of example and not limitation, a substantially uniform gap of between about 50 microns (0.002 inch) and about 150 microns (0.006 inch) may be provided between the shank 20 and the bit body 72 when the retaining members 46 are disposed within the apertures 21 in the shank 20 and the grooves 16 in the bit body 72.

A brazing material 26 such as, for example, a silver-based or a nickel-based metal alloy may be provided in the substantially uniform gap between the shank 20 and the surfaces 14 of the second region 76 of the bit body 72. As an alternative to brazing, or in addition to brazing, a weld 24 may be provided around the rotary drill bit 70 on an exterior surface thereof along an interface between the bit body 72 and the steel shank 20. The weld 24 and the brazing material 26 may be used to further secure the shank 20 to the bit body 72. In this configuration, if the brazing material 26 in the substantially uniform gap between the shank 20 and the surfaces 14 in the second region 76 of the bit body 72 and the weld 24 should fail while the drill bit 70 is located at the bottom of a wellbore during a drilling operation, the retaining members 46 may prevent longitudinal separation of the bit body 72 from the shank 20, thereby preventing loss of the bit body 72 in the wellbore.

As previously stated, the first region 74 of the bit body 72 may have a first material composition and the second region 76 of the bit body 72 may have a second, different material composition. The first region 74 may include a particle-matrix composite material comprising a plurality of hard phase regions or particles dispersed throughout a titanium or titanium-based alloy matrix material. The second region 76 of the bit body 72 may include a metal, a metal alloy, or a particle-matrix composite material. For example, the second region 76 of the bit body 72 may be predominantly comprised of a titanium or a titanium-based alloy material substantially identical to the matrix material of the particle-matrix composite material in the first region 74. In additional embodiments of the present invention, both the first region 74 and the second region 76 of the bit body 72 may be substantially formed from and at least predominantly composed of a particle-matrix composite material.

By way of example and not limitation, the first region 74 of the bit body 72 may include a plurality of titanium carbide and/or titanium diboride regions or particles dispersed throughout a matrix material comprising any one of the $\alpha+\beta$ alloys set forth in Table 1, the beta ($\beta$) alloys set forth in Table 2, or the metastable beta ($\beta$) alloys set forth in Table 3, and the second region 74 of the bit body 72 may comprise any one of the alpha ($\alpha$) alloys set forth in Table 4. In additional embodiments, the second region 74 of the bit body 72 may comprise any one of the $\alpha+\beta$ alloys set forth in Table 1, the beta ($\beta$) alloys set forth in Table 2, or the metastable beta ($\beta$) alloys set forth in Table 3. In this configuration, the material composition of the first region 74 may be selected to exhibit higher erosion and wear-resistance than the material composition of the second region 76. Furthermore, the material composition of the second region 76 may be selected to enhance machinability of the second region 76 and facilitate attachment of the bit body 72 to the shank 20.

The manner in which the physical properties maybe tailored to facilitate machining of the second region 76 may be at least partially dependent of the method of machining that is to be used. For example, if it is desired to machine the second region 76 using conventional turning, milling, and drilling techniques, the material composition of the second region 76 maybe selected to exhibit lower hardness and higher ductility. If it is desired to machine the second region 76 using ultrasonic machining techniques, which may include the use of ultrasonically induced vibrations delivered to a tool, the composition of the second region 76 may be selected to exhibit a higher hardness and a lower ductility.

In some embodiments, the material composition of the second region 76 may be selected to exhibit higher fracture toughness than the material composition of the first region 74. In yet other embodiments, the material composition of the second region 76 maybe selected to exhibit physical properties that are tailored to facilitate welding of the second region 76. By way of example and not limitation, the material composition of the second region 76 may be selected to facilitate welding of the second region 76 to the shank 20. It is understood that the various regions of the bit body 72 may have material compositions that are selected or tailored to exhibit any desired particular physical property or characteristic, and the present invention is not limited to selecting or tailing the material compositions of the regions to exhibit the particular physical properties or characteristics described herein.

Certain physical properties and characteristics of a composite material (such as hardness) may be defined using an appropriate rule of mixtures, as is known in the art. Other physical properties and characteristics of a composite material may be determined without resort to the rule of mixtures. Such physical properties may include, for example, erosion and wear resistance.

FIGS. 3A-3J illustrate one example of a method that may be used to form the bit body 72 shown in FIG. 2. Generally, the bit body 72 of the rotary drill bit 70 may be formed by separately forming the first region 74 and the second region 76 as brown structures, assembling the brown structures together to provide a unitary brown bit body, and sintering the unitary brown bit body to a desired final density.

Figure 3A:
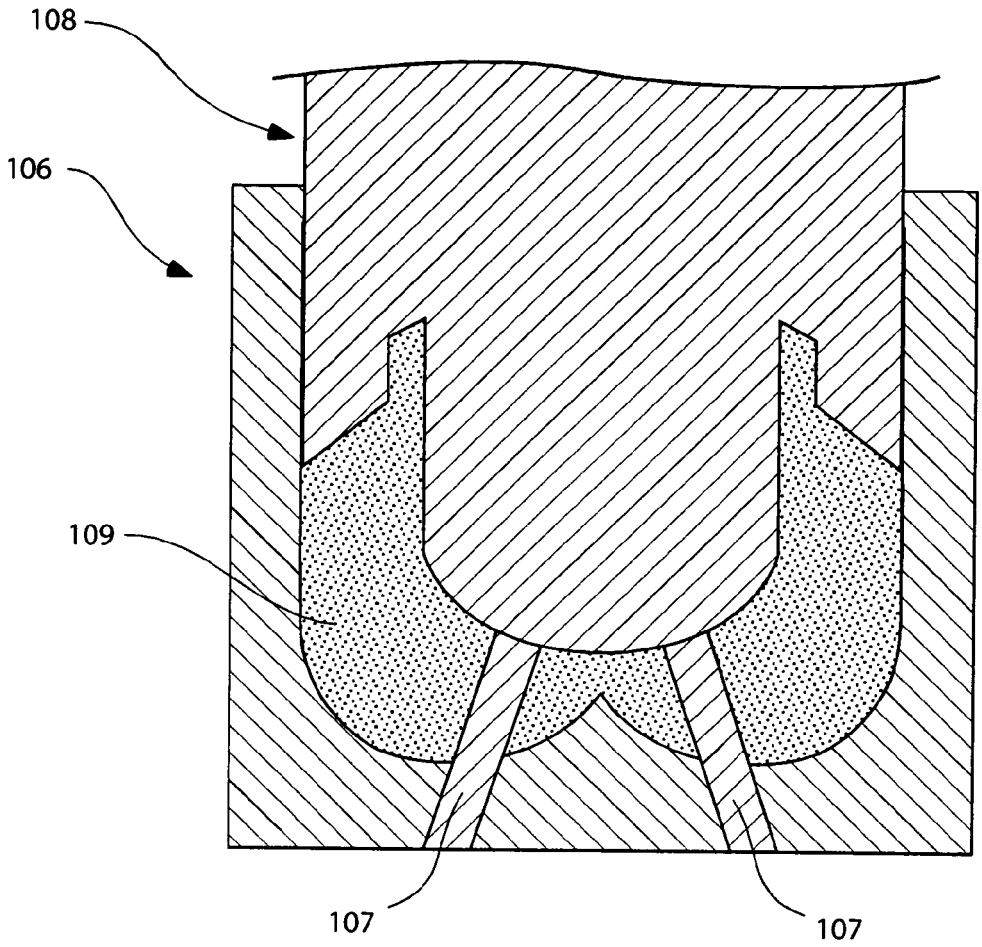
FIGS. 3A-3J illustrate one example of a method that may be used to form the bit body of the earth-boring rotary drill bit shown in FIG. 2.

Referring to FIG. 3A, a first powder mixture 109 may be pressed in a mold or die 106 using a movable piston or plunger 108. The first powder mixture 109 may include a plurality of hard particles and a plurality of particles comprising a titanium or a titanium-based alloy matrix material. By way of example and not limitation, the first powder mixture 109 may include a plurality of titanium carbide and/or titanium diboride particles, as well as a plurality of particles each comprising any of the α+β alloys set forth in Table 1, the beta (β) alloys set forth in Table 2, or the metastable beta (β) alloys set forth in Table 3. Optionally, the powder mixture 109 may further include additives commonly used when pressing powder mixtures such as, for example, binders for providing lubrication during pressing and for providing structural strength to the pressed powder component, plasticizers for making the binder more pliable, and lubricants or compaction aids for reducing inter-particle friction.

The die 106 may include an inner cavity having surfaces shaped and configured to form at least some surfaces of the first region 74 of the bit body 72. The plunger 108 may also have surfaces configured to form or shape at least some of the surfaces of the first region 74 of the bit body 72. Inserts or displacements 107 may be positioned within the die 106 and used to define the internal fluid passageways 42. Additional displacements 107 (not shown) may be used to define cutting element pockets 36, junk slots 32, and other topographic features of the first region 74 of the bit body 72.

Figure 3B:
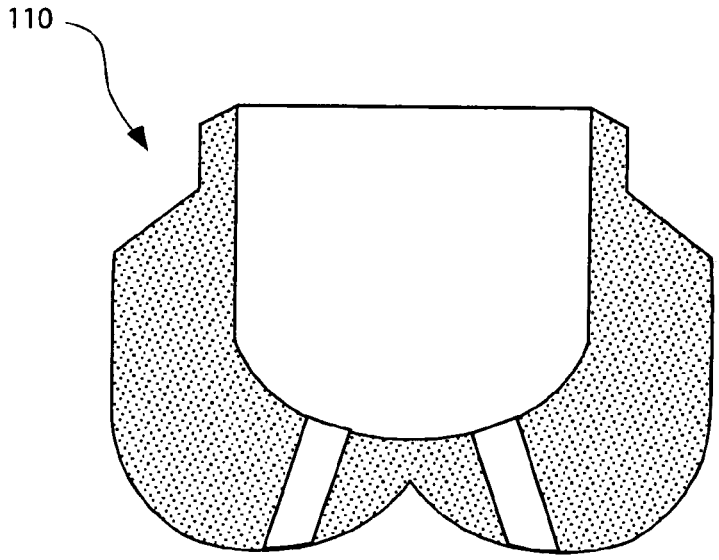
Figure 3C:
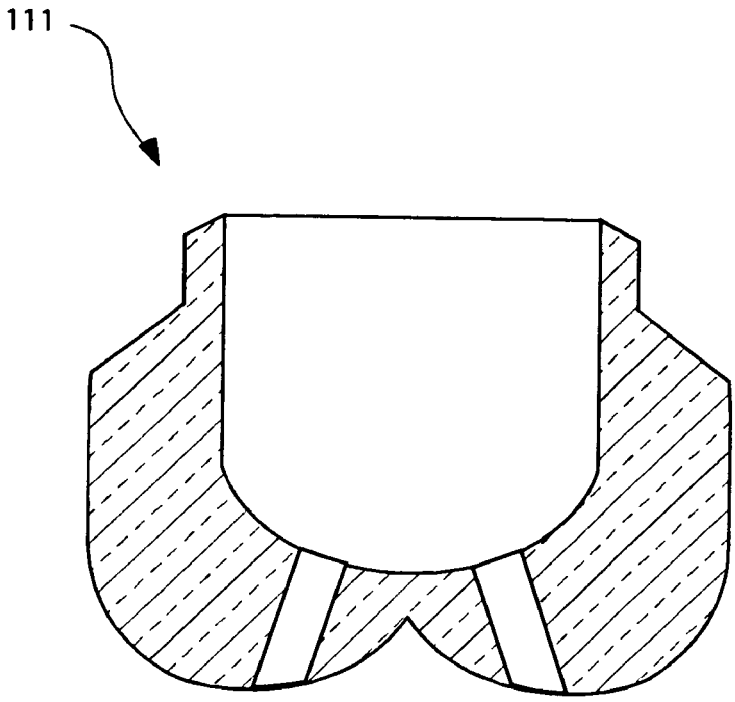

The plunger 108 may be advanced into the die 106 at high force using mechanical or hydraulic equipment or machines to compact the first powder mixture 109 within the die 106 to form a first green powder component 110, shown in FIG. 3B. The die 106, plunger 108, and the first powder mixture 109 optionally may be heated during the compaction process.

In additional methods of pressing the powder mixture 109, the powder mixture 109 may be pressed with substantially isostatic pressures inside a pliable, hermetically sealed container that is provided within a pressure chamber.

The first green powder component 110 shown in FIG. 3B may include a plurality of particles (hard particles of hard material and particles of matrix material) held together by a binder material provided in the powder mixture 109 (FIG. 3A), as previously described. Certain structural features may be machined in the green powder component 110 using conventional machining techniques including, for example, turning techniques, milling techniques, and drilling techniques. Hand held tools also may be used to manually form or shape features in or on the green powder component 110. By way of example and not limitation, junk slots 32 (FIG. 2) may be machined or otherwise formed in the green powder component 110.

The first green powder component 110 shown in FIG. 3B may be at least partially sintered. For example, the green powder component 110 may be partially sintered to provide a first brown structure 111 shown in FIG. 3C, which has less than a desired final density. Prior to sintering, the green powder component 110 may be subjected to moderately elevated temperatures to aid in the removal of any fugitive additives that were included in the powder mixture 109 (FIG. 3A), as previously described. Furthermore, the green powder component 1 0 may be subjected to a suitable atmosphere tailored to aid in the removal of such additives. Such atmospheres may include, for example, hydrogen gas at a temperature of about 500° C.

Certain structural features may be machined in the first brown structure 111 using conventional machining techniques including, for example, turning techniques, milling techniques, and drilling techniques. Hand held tools may also be used to manually form or shape features in or on the brown structure 111. By way of example and not limitation, cutter pockets 36 may be machined or otherwise formed in the brown structure 111 to form a shaped brown structure 112 shown in FIG. 3D.

Figure 3D:
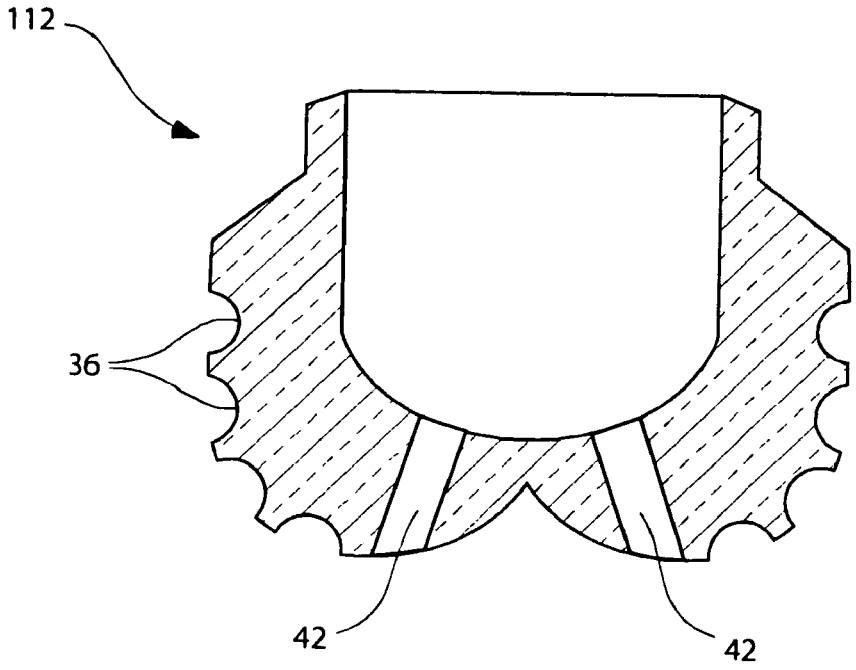
Figure 3E:
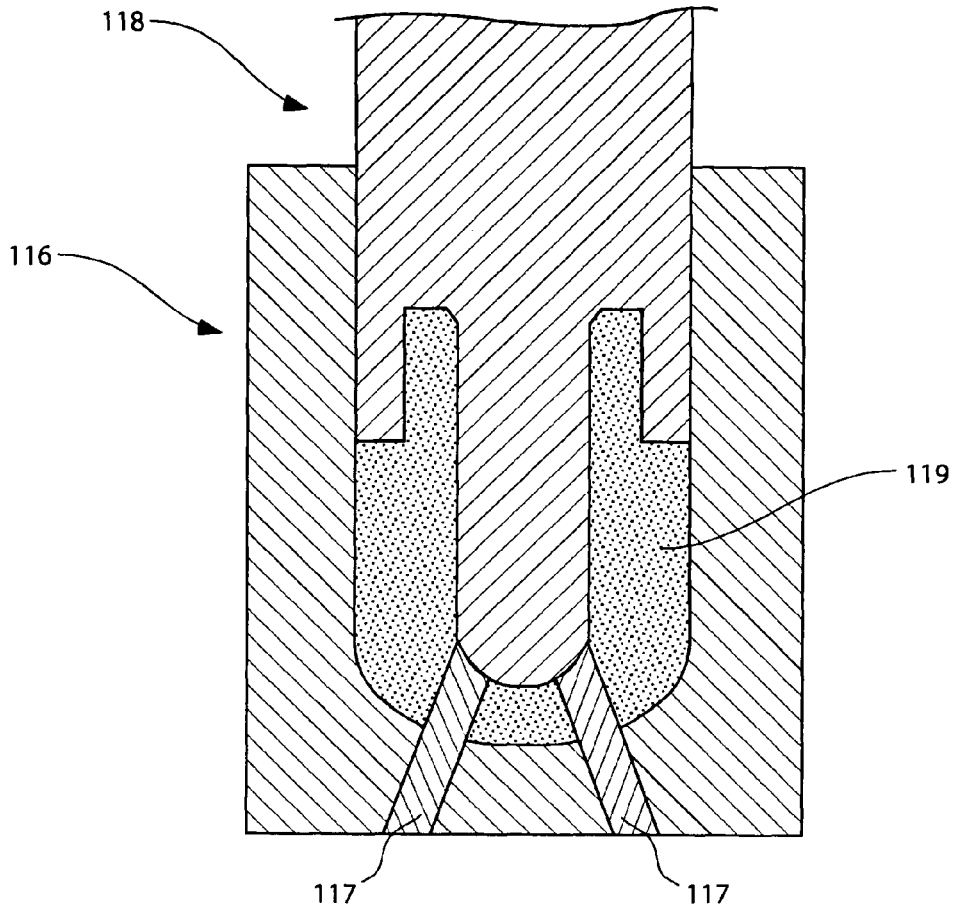

Referring to FIG. 3E, a second powder mixture 119 may be pressed in a mold or die 116 using a movable piston or plunger 118. The second powder mixture 119 may include a plurality of particles comprising a titanium or titanium-based alloy matrix material, and optionally may include a plurality of hard particles comprising a hard material. By way of example and not limitation, the second powder mixture 119 may include a plurality of particles each comprising any of the alpha (α) alloys set forth in Table 4. As additional examples, the second powder mixture 119 may include a plurality of particles each comprising any of the α+β alloys set forth in Table 1, any of the beta (β) alloys set forth in Table 2, or any of the metastable beta (β) alloys set forth in Table 3. In some embodiments, the second powder mixture 119 may be substantially similar to the first powder mixture 109 previously described with reference to FIG. 3A, with the exception of the absence of a plurality of hard particles (e.g., titanium carbide and/or titanium diboride) in the second powder mixture 119. Optionally, the powder mixture 119 may further include additives commonly used when pressing powder mixtures such as, for example, binders for providing lubrication during pressing and for providing structural strength to the pressed powder component, plasticizers for making the binder more pliable, and lubricants or compaction aids for reducing inter-particle friction.

The die 116 may include an inner cavity having surfaces shaped and configured to form at least some surfaces of the second region 76 of the bit body 72. The plunger 118 may also have surfaces configured to form or shape at least some of the surfaces of the second region 76 of the bit body 72. One or more inserts or displacements 117 may be positioned within the die 116 and used to define the internal fluid passageways 42. Additional displacements 117 (not shown) may be used to define other topographic features of the second region 76 of the bit body 72 as necessary.

Figure 3F:
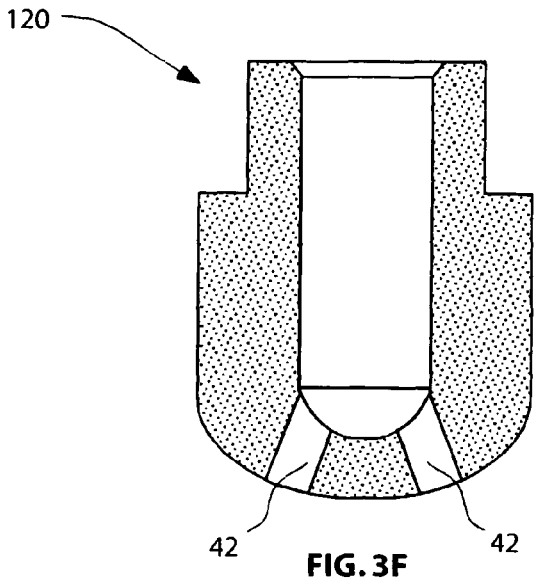

The plunger 118 maybe advanced into the die 116 at high force using mechanical or hydraulic equipment or machines to compact the second powder mixture 119 within the die 116 to form a second green powder component 120, shown in FIG. 3F. The die 116, plunger 118, and the second powder mixture 119 optionally may be heated during the compaction process.

The second green powder component 120 shown in FIG. 3F may include a plurality of particles (particles of titanium or titanium-based alloy matrix material, and optionally, hard particles comprising a hard material) held together by a binder material provided in the powder mixture 119 (FIG. 3E), as previously described. Certain structural features maybe machined in the green powder component 120 as necessary using conventional machining techniques including, for example, turning techniques, milling techniques, and drilling techniques. Hand held tools also may be used to manually form or shape features in or on the green powder component 120.

The second green powder component 120 shown in FIG. 3F maybe at least partially sintered. For example, the green powder component 120 may be partially sintered to provide a second brown structure 121 shown in FIG. 3G, which has less than a desired final density. Prior to sintering, the green powder component 120 maybe subjected to moderately elevated temperatures to burn off or remove any fugitive additives that were included in the powder mixture 119 (FIG. 3E), as previously described.

Certain structural features may be machined in the second brown structure 121 as necessary using conventional machining techniques including, for example, turning techniques, milling techniques, and drilling techniques. Hand held tools may also be used to manually form or shape features in or on the brown structure 121.

Figure 3G:
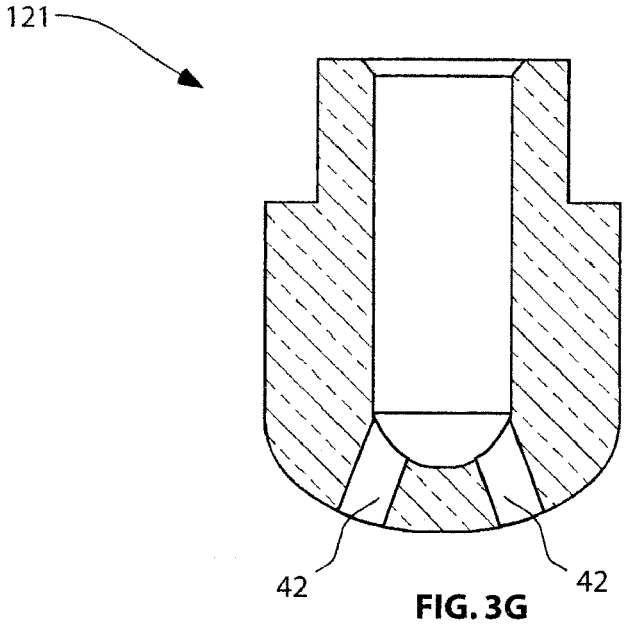
Figure 3H:
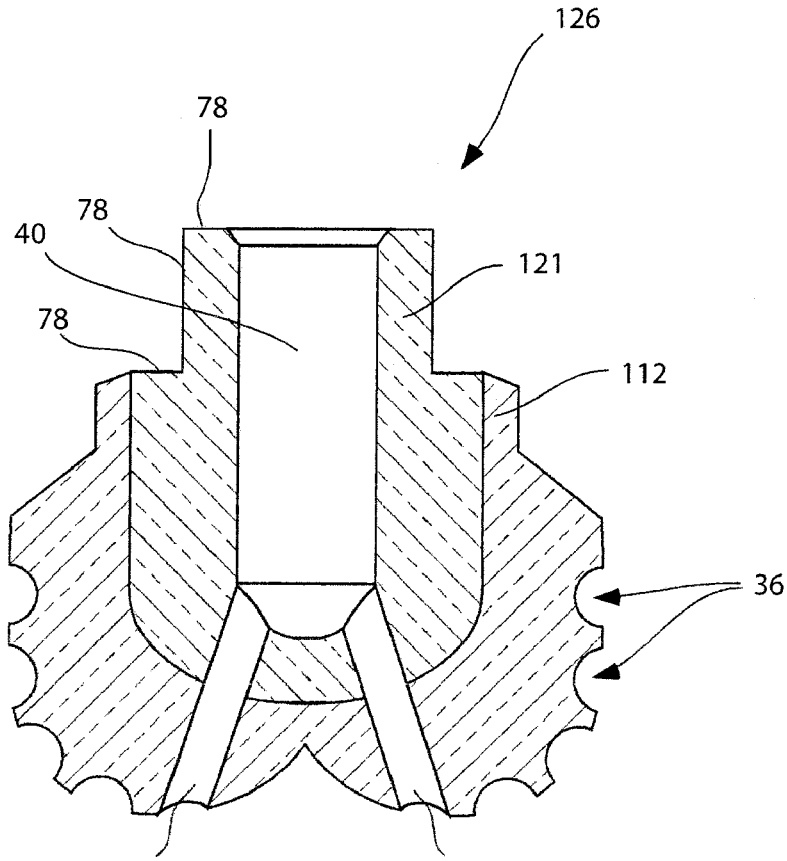

The brown structure 121 shown in FIG. 3G then may be inserted into the previously formed shaped brown structure 112 shown in FIG. 3D to provide a unitary brown bit body 126 shown in FIG. 3H. The unitary brown bit body 126 then may be fully sintered to a desired final density to provide the previously described bit body 72 shown in FIG. 2. As sintering involves densification and removal of porosity within a structure, the structure being sintered will shrink during the sintering process. A structure may experience linear shrinkage of, for example, between 10% and 20% during sintering. As a result, dimensional shrinkage must be considered and accounted for when designing tooling (molds, dies, etc.) or machining features in structures that are less than fully sintered.

In another method, the green powder component 120 shown in FIG. 3F may be inserted into or assembled with the green powder component 110 shown in FIG. 3B to form a green bit body. The green bit body then may be machined as necessary and sintered to a desired final density. The interfacial surfaces of the green powder component 110 and the green powder component 120 may be fused or bonded together during sintering processes. In other methods, the green bit body may be partially sintered to a brown bit body. Shaping and machining processes may be performed on the brown bit body as necessary, and the resulting brown bit body then may be sintered to a desired final density.

The material composition of the first region 74 (and therefore, the composition of the first powder mixture 109 shown in FIG. 3A) and the material composition of the second region 76 (and therefore, the composition of the second powder mixture 119 shown in FIG. 3E) may be selected to exhibit substantially similar shrinkage during the sintering processes.

The sintering processes described herein may include conventional sintering in a vacuum furnace, sintering in a vacuum furnace followed by a conventional hot isostatic pressing process, and sintering immediately followed by isostatic pressing at temperatures near the sintering temperature (often referred to as sinter-HIP). Furthermore, the sintering processes described herein may include subliquidus phase sintering. In other words, the sintering processes may be conducted at temperatures proximate to but below the liquidus line of the phase diagram for the matrix material. For example, the sintering processes described herein maybe conducted using a number of different methods known to one of ordinary skill in the art such as the Rapid Omnidirectional Compaction (ROC) process, the CERACON® process, hot isostatic pressing (HIP), or adaptations of such processes.

Broadly, and by way of example only, sintering a green powder compact using the ROC process involves presintering the green powder compact at a relatively low temperature to only a sufficient degree to develop sufficient strength to permit handling of the powder compact. The resulting brown structure is wrapped in a material such as graphite foil to seal the brown structure. The wrapped brown structure is placed in a container, which is filled with particles of a hard, polymer, or glass material having a substantially lower melting point than that of the matrix material in the brown structure. The container is heated to the desired sintering temperature, which is above the melting temperature of the particles of a ceramic, polymer, or glass material, but below the liquidus temperature of the matrix material in the brown structure. The heated container with the molten ceramic, polymer, or glass material (and the brown structure immersed therein) is placed in a mechanical or hydraulic press, such as a forging press, that is used to apply pressure to the molten ceramic or polymer material. Isostatic pressures within the molten ceramic, polymer, or glass material facilitate consolidation and sintering of the brown structure at the elevated temperatures within the container. The molten ceramic, polymer, or glass material acts to transmit the pressure and heat to the brown structure. In this manner, the molten ceramic, polymer, or glass acts as a pressure transmission medium through which pressure is applied to the structure during sintering. Subsequent to the release of pressure and cooling, the sintered structure is then removed from the ceramic, polymer, or glass material. A more detailed explanation of the ROC process and suitable equipment for the practice thereof is provided by U.S. Pat. Nos. 4,094,709, 4,233,720, 4,341,557, 4,526,748, 4,547,337, 4,562,990, 4,596,694, 4,597,730, 4,656,002 4,744,943 and 5,232,522, the disclosure of each of which patents is incorporated herein by reference.

The CERACON® process, which is similar to the aforementioned ROC process, may also be adapted for use in the present invention to fully sinter brown structures to a final density. In the CERACON® process, the brown structure is coated with a ceramic coating such as alumina, zirconium oxide, or chrome oxide. Other similar, hard, generally inert, protective, removable coatings may also be used. The coated brown structure is fully consolidated by transmitting at least substantially isostatic pressure to the coated brown structure using ceramic particles instead of a fluid media as in the ROC process. A more detailed explanation of the CERACON® process is provided by U.S. Pat. No. 4,499,048, the disclosure of which patent is incorporated herein by reference.

As previously described, the material composition of the second region 76 of the bit body 72 may be selected to facilitate the machining operations performing on the second region 76, even in the fully sintered state. After sintering the unitary brown bit body 126 shown in FIG. 3H to the desired final density, certain features may be machined in the fully sintered structure to provide the bit body 72, which is shown separate from the shank 20 (FIG. 2) in FIG. 3I. For example, the surfaces 14 of the second region 76 of the bit body 72 may be machined to provide elements or features for attaching the shank 20 (FIG. 2) to the bit body 72. By way of example and not limitation, two grooves 16 may be machined in a surface 78 of the second region 76 of the bit body 72, as shown in FIG. 31. Each groove 16 may have, for example, a semi-circular cross section. Furthermore, each groove 16 may extend radially around a portion of the second region 76 of the bit body 72, as illustrated in FIG. 3J. In this configuration, the surface of the second region 76 of the bit body 72 within each groove 16 may have a shape comprising an angular section of a partial toroid. As used herein, the term "toroid" means a surface generated by a closed curve (such as a circle) rotating about, but not intersecting or containing, an axis disposed in a plane that includes the closed curve. In other embodiments, the surface of the second region 76 of the bit body 72 within each groove 16 may have a shape that substantially forms a partial cylinder. The two grooves 16 may be located on substantially opposite sides of the second region 76 of the bit body 72, as shown in FIG. 3J.

As described herein, the first region 74 and the second region 76 of the bit body 72 may be separately formed in the brown state and assembled together to form a unitary brown structure, which can then be sintered to a desired final density. In additional methods of forming the bit body 72, the first region 74 may be formed by pressing a first powder mixture in a die to form a first green powder component, adding a second powder mixture to the same die and pressing the second powder mixture within the die together with the first powder component of the first region 74 to form a monolithic green bit body. Furthermore, a first powder mixture and a second powder mixture may be provided in a single die and simultaneously pressed to form a monolithic green bit body. The monolithic green bit body then may be machined as necessary and sintered to a desired final density. In yet other methods, the monolithic green bit body may be partially sintered to a brown bit body. Shaping and machining processes may be performed on the brown bit body as necessary, and the resulting brown bit body then may be sintered to a desired final density. The monolithic green bit body may be formed in a single die using two different plungers, such as the plunger 108 shown in FIG. 3A and the plunger 118 shown in FIG. 3E. Furthermore, additional powder mixtures may be provided as necessary to provide any desired number of regions within the bit body 72 having a material composition.

Figure 4A:
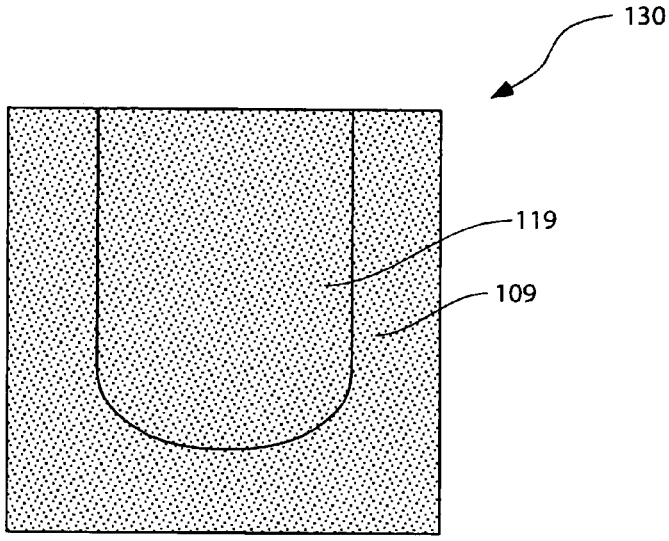
FIGS. 4A-4C illustrate another example of a method that maybe used to form the bit body of the earth-boring rotary drill bit shown in FIG. 2.
Figure 4B:
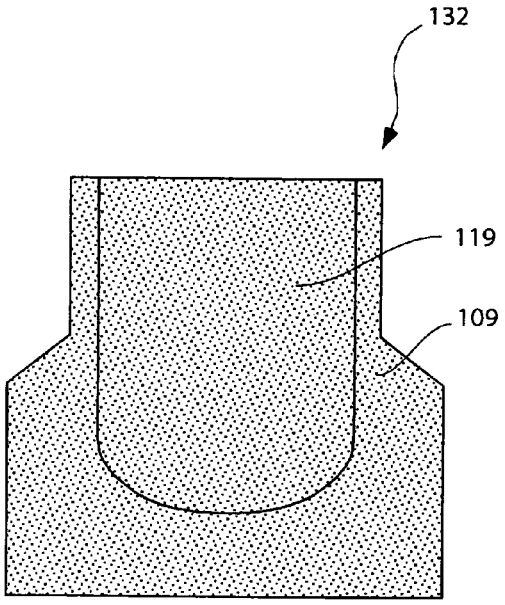
Figure 4C:
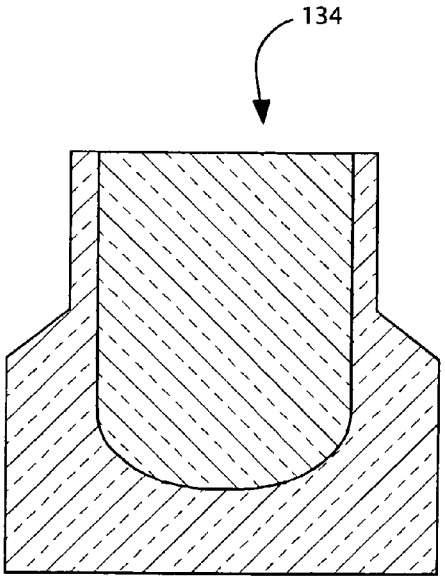

FIGS. 4A-4C illustrate another method of forming the bit body 72. Generally, the bit body 72 of the rotary drill bit 70 may be formed by pressing the previously described first powder mixture 109 (FIG. 3A) and the previously described second powder mixture 119 (FIG. 3E) to form a generally cylindrical monolithic green bit body 130 or billet, as shown in FIG. 4A. By way of example and not limitation, the generally cylindrical monolithic green bit body 130 may be formed by substantially simultaneously isostatically pressing the first powder mixture 109 and the second powder mixture 119 together in a pressure chamber.

By way of example and not limitation, the first powder mixture 109 and the second powder mixture 119 may be provided within a container. The container may include a fluid-tight deformable member, such as, for example, a substantially cylindrical bag comprising a deformable polymer material. The container (with the first powder mixture 109 and the second powder mixture 119 contained therein) may be provided within a pressure chamber. A fluid, such as, for example, water, oil, or gas (such as, for example, air or nitrogen) may be pumped into the pressure chamber using a pump. The high pressure of the fluid causes the walls of the deformable member to deform. The pressure may be transmitted substantially uniformly to the first powder mixture 109 and the second powder mixture 119. The pressure within the pressure chamber during isostatic pressing may be greater than about 35 megapascals (about 5,000 pounds per square inch). More particularly, the pressure within the pressure chamber during isostatic pressing may be greater than about 138 megapascal (20,000 pounds per square inch). In additional methods, a vacuum may be provided within the container and a pressure greater than about 0.1 megapascals (about 15 pounds per square inch), may be applied to the exterior surfaces of the container (by, for example, the atmosphere) to compact the first powder mixture 109 and the second powder mixture 119. Isostatic pressing of the first powder mixture 109 and the second powder mixture 119 may form the generally cylindrical monolithic green bit body 130 shown in FIG. 4A, which can be removed from the pressure chamber after pressing.

The generally cylindrical monolithic green bit body 130 shown in FIG. 4A may be machined or shaped as necessary. By way of example and not limitation, the outer diameter of an end of the generally cylindrical monolithic green bit body 130 may be reduced to form the shaped monolithic green bit body 132 shown in FIG. 4B. For example, the generally cylindrical monolithic green bit body 130 may be turned on a lathe to form the shaped monolithic green bit body 132. Additional machining or shaping of the generally cylindrical monolithic green bit body 130 maybe performed as necessary or desired. In other methods, the generally cylindrical monolithic green bit body 130 may be turned on a lathe to ensure that the monolithic green bit body 130 is substantially cylindrical without reducing the outer diameter of an end thereof or otherwise changing the shape of the monolithic green bit body 130.

The shaped monolithic green bit body 132 shown in FIG. 4B then may be partially sintered to provide a brown bit body 134 shown in FIG. 4C. The brown bit body 134 then may be machined as necessary to form a structure substantially identical to the previously described shaped unitary brown bit body 126 shown in FIG. 3H. By way of example and not limitation, the longitudinal bore 40 and internal fluid passageways 42 (FIG. 3H) may be formed in the brown bit body 134 (FIG. 4C) by, for example, using a machining process. A plurality of pockets 36 for PDC cutters 34 also may be machined in the brown bit body 134 (FIG. 4C). Furthermore, at least one surface 78 (FIG. 3H) that is configured for attachment of the bit body 72 to the shank 20 may be machined in the brown bit body 134 (FIG. 4C).

After the brown bit body 134 shown in FIG. 4C has been machined to form a structure substantially identical to the shaped unitary brown bit body 126 shown in FIG. 3H, the structure may be further sintered to a desired final density and certain additional features may be machined in the fully sintered structure as necessary to provide the bit body 72 shown in FIG. 31, as previously described.

In additional embodiments, the bit body 72 may be formed using a conventional infiltration process. For example, a plurality of particles each comprising a hard material (e.g., titanium carbide, titanium diboride, etc.) may be provided in a region of a cavity of a graphite mold (or a mold formed from any other refractory material) that is configured to form the first region 74 of the bit body 72. Preform elements or displacements (which may comprise ceramic components, graphite components, or resin-coated sand compact components) may be positioned within the mold and used to define the internal passages 42, cutting element pockets 36, junk slots 32, and other external or internal topographic features of the bit body 12. Furthermore, a preform element or displacement may be positioned in a region of the cavity of the graphite mold that is configured to form the second region 76 of the bit body 72.

A titanium or titanium-based alloy matrix material may be melted, poured into the mold cavity, and caused to infiltrate the particles comprising hard material to form the first region 74 of the bit body 72. The mold and partially formed bit body may be allowed to cool to solidify the molten matrix material. The preform element or displacement previously positioned in the region of the cavity of the graphite mold configured to form the second region 76 of the bit body 72 may be removed from the mold cavity, and another preform element or displacement may be positioned in a region of the cavity of the graphite mold corresponding to the internal longitudinal bore 40. The second region 76 of the bit body then may be formed in a manner substantially similar to that previously described in relation to the first region 74. If the second region 76 of the bit body 72 is to comprise a titanium or titanium-based alloy material without any hard phase regions or particles, the titanium or titanium-based alloy material may simply be melted and poured into the mold cavity without pre-packing or filling the mold cavity with hard particles.

Once the bit body 72 has cooled, the bit body 72 may be removed from the mold and any displacements may be removed from the bit body 72. Destruction of the graphite mold may be required to remove the bit body 72.

Figure 3I:
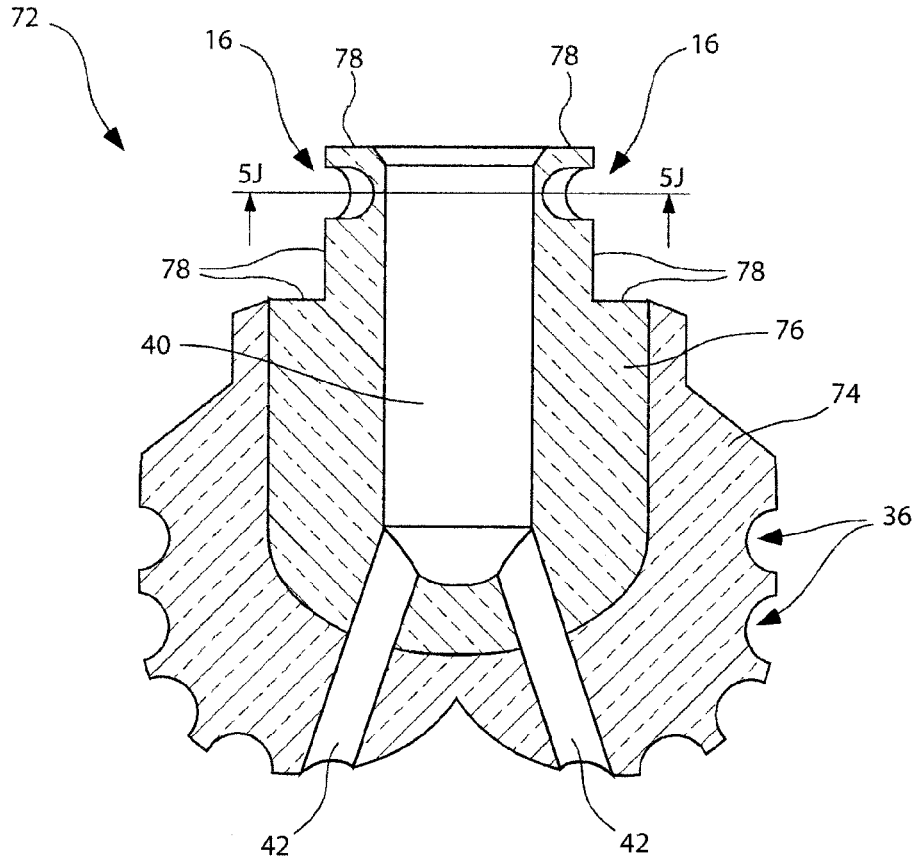
Figure 3J:
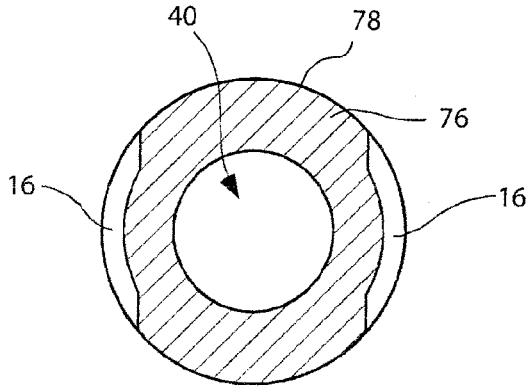

At least a portion of the bit body 72 shown in FIG. 3I may be subjected to one or more thermal treatment processes (i.e., heat treated) to refine or tailor the microstructure of a material of the bit body 72 and impart one or more desired physical properties (i.e., increased strength, hardness, fracture toughness, etc.) to the material of the bit body 72, as necessary or desired. By way of example and not limitation, at least a portion of the bit body 72 may be annealed to increase or otherwise selectively tailor the fracture toughness of the bit body 72. In general, titanium alloys may be annealed to increase fracture toughness, ductility at room temperature, dimensional and thermal stability, and creep resistance. The time and temperature for any annealing process is dependent upon the particular titanium alloy being annealed and the microstructure and physical properties desired to be imparted to the material, and the general procedures for determining a suitable annealing time and temperature for imparting such microstructure and physical properties to the material are within the general knowledge of those of ordinary skill in the art.

As another example, at least a portion of the bit body 72 comprising an $\alpha+\beta$ alloy , a beta ($\beta$) alloy, or a metastable beta ($\beta$) alloy may be solution-treated (ST) or solution-treated and aged (STA) to refine or tailor the microstructure of a material of the bit body 72 and impart one or more desired physical properties (e.g., increased strength) to the material of the bit body 72, as necessary or desired. In general, titanium-based alloys may be solution-treated by heating the titanium-based alloy to a solution temperature proximate (slightly above or slightly below) the beta transus temperature (e.g., between about 690° C. and about 1060° C.) for between about one-quarter of an hour to about two hours to allow the phases to equilibrate at the solution temperature. The material is then quenched (i.e., rapidly cooled) from the solution temperature to room temperature using air and/or water. Upon quenching, at least some regions comprising high-temperature beta ($\beta$) phase may be trapped or preserved within the microstructure of the titanium-based alloy material in a metastable, non-equilibrium state. Upon aging, at least a portion of these metastable, non-equilibrium phases may decompose to a stable, equilibrium phase. Solution-treated titanium-based alloys are aged at temperatures below the solution temperature, generally between about 390° C. and about 760° C., for times ranging from about two hours up to several hundred hours. Again, the time and temperature for any solution-treating and/or aging process is dependent upon the particular titanium alloy being treated and the microstructure and physical properties desired to be imparted to the material, and the general procedures for determining a suitable treating time and temperature for imparting such microstructure and physical properties to the material are within the general knowledge of those of ordinary skill in the art.

As titanium alloys are generally susceptible to oxidation, any thermal treatment process may be carried out in a controlled inert environment.

Optionally, at least a portion of an exterior surface of the bit body 72 may be nitrided before or after the bit body 72 has been thermally treated as necessary or desired, which may increase the hardness and/or the wear-resistance of the particle-matrix composite material 15 at the exposed, formation-engaging surfaces of the bit body 72. By way of example and not limitation, the bit body 72 may be nitrided using a plasma nitriding process in a plasma chamber. The process temperature for conducting plasma nitriding of titanium and its alloys varies from about 425° C. to about 725° C., the optimum temperature depending on the particular material composition and other parameters. Any titanium oxide at or on the exterior surface of the bit body 72 may be removed prior to nitriding. By way of example and not limitation, an exterior surface of the bit body 72 may be nitrided in an atmosphere comprising a mixture of nitrogen gas and hydrogen gas (e.g., between about 20% and about 60% by volume nitrogen gas) at pressures ranging from, for example, a few milipascals to several kilopascals or more and for a time ranging from, for example, several minutes to several hours or more.

In additional methods, selected areas or regions of the exposed, formation-engaging surfaces of the bit body 72 may be nitrided using a laser nitriding process. By way of example and not limitation, an exterior surface of the bit body 72 may be nitrided by irradiating the surface of the bit body 72 with intense pulsed ion beam (IPIB) radiation at room temperature, which may allow the physical properties of the bulk material to remain substantially unaffected. Such irradiation may be carried out, for example, in an atmosphere comprising nitrogen gas under vacuum conditions (e.g., at pressures of less than about 0.02 pascal).

Referring again to FIG. 2, the shank 20 may be attached to the bit body 72 by providing a brazing material 26 such as, for example, a silver-based or nickel-based metal alloy in the gap between the shank 20 and the surfaces 14 in the second region 76 of the bit body 72. As an alternative to brazing, or in addition to brazing, a weld 24 may be provided around the rotary drill bit 70 on an exterior surface thereof along an interface between the bit body 72 and the steel shank 20. The brazing material 26 and the weld 24 may be used to secure the shank 20 to the bit body 72.

Figure 5:
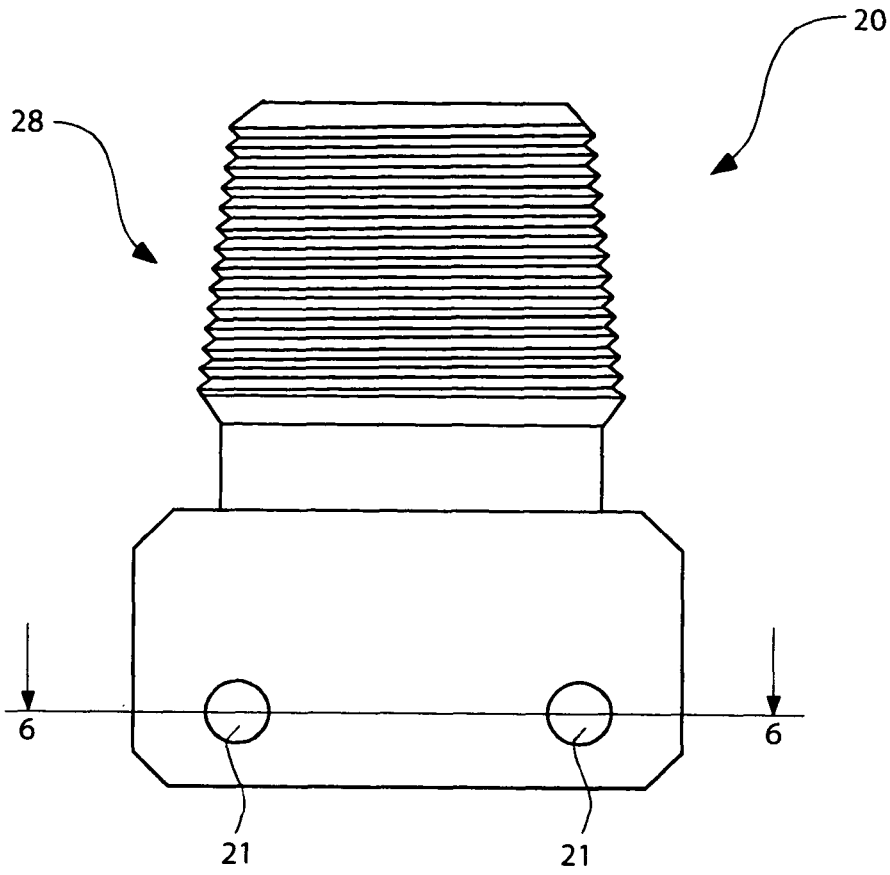
FIG. 5 is a side view of a shank shown in FIG. 2.
Figure 6:
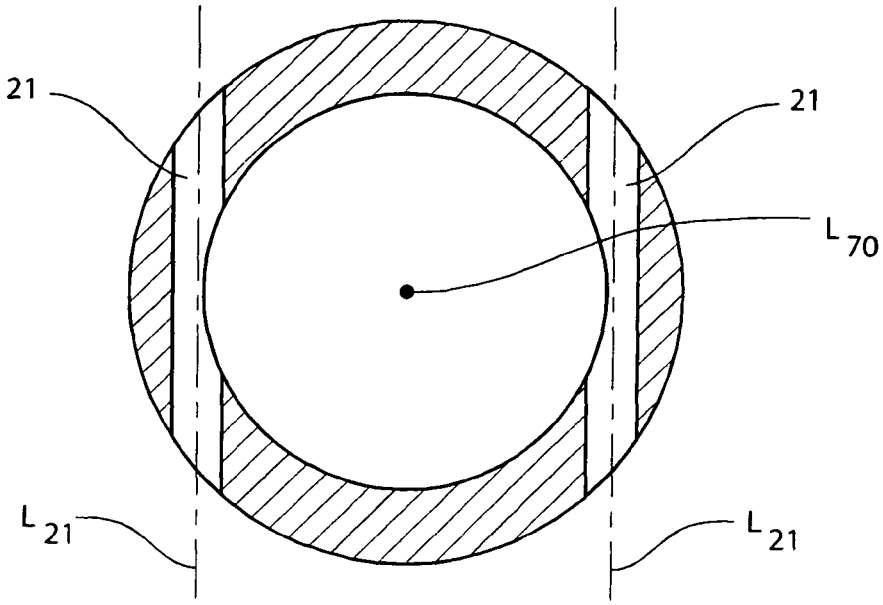
FIG. 6 is a cross-sectional view of the shank shown in FIG. 5 taken along section line 6-6 shown therein.

In additional methods, structures or features that provide mechanical interference may be used in addition to, or instead of, the brazing material 26 and weld 24 to secure the shank 20 to the bit body 72. An example of such a method of attaching a shank 20 to the bit body 72 is described below with reference to FIG. 2 and FIGS. 5-7. Referring to FIG. 5, two apertures 21 may be provided through the shank 20, as previously described in relation to FIG. 2. Each aperture 21 may have a size and shape configured to receive a retaining member 46 (FIG. 2) therein. By way of example and not limitation, each aperture 21 may have a substantially cylindrical cross section and may extend through the shank 20 along an axis $L_{21}$, as shown in FIG. 6. The location and orientation of each aperture 21 in the shank 20 may be such that each axis $L_{21}$ lies in a plane that is substantially perpendicular to the longitudinal axis $L_{70}$ of the drill bit 70, but does not intersect the longitudinal axis $L_{70}$ of the drill bit 70.

When a retaining member 46 is inserted through an aperture 21 of the shank 20 and a groove 16, the retaining member 46 may abut against a surface of the second region 76 of the bit body 72 within the groove 16 along a line of contact if the groove 16 has a shape comprising an angular section of a partial toroid, as shown in FIGS. 3I and 3J. If the groove 16 has a shape that substantially forms a partial cylinder, however, the retaining member 46 may abut against an area on the surface of the second region 76 of the bit body 72 within the groove 16.

In some embodiments, each retaining member 46 may be secured to the shank 20. By way of example and not limitation, if each retaining member 46 includes an elongated, cylindrical rod as shown in FIG. 2, the ends of each retaining member 46 may be welded to the shank 20 along the interface between the end of each retaining member 46 and the shank 20. In additional embodiments, a brazing or soldering material (not shown) may be provided between the ends of each retaining member 46 and the shank 20. In still other embodiments, threads may be provided on an exterior surface of each end of each retaining member 46 and cooperating threads maybe provided on surfaces of the shank 20 within the apertures 21.

Referring again to FIG. 2, the brazing material 26 such as, for example, a silver-based or nickel-based metal alloy may be provided in the substantially uniform gap between the shank 20 and the surfaces 14 in the second region 76 of the bit body 72. The weld 24 may be provided around the rotary drill bit 70 on an exterior surface thereof along an interface between the bit body 72 and the steel shank 20. The weld 24 and the brazing material 26 may be used to further secure the shank 20 to the bit body 72. In this configuration, if the brazing material 26 in the substantially uniform gap between the shank 20 and the surfaces 14 in the second region 76 of the bit body 72 and the weld 24 should fail while the drill bit 70 is located at the bottom of a wellbore during a drilling operation, the retaining members 46 may prevent longitudinal separation of the bit body 72 from the shank 20, thereby preventing loss of the bit body 72 in the wellbore.

In additional methods of attaching the shank 20 to the bit body 72, only one retaining member 46 or more than two retaining members 46 may be used to attach the shank 20 to the bit body 72. In yet other embodiments, a threaded connection may be provided between the second region 76 of the bit body 72 and the shank 20. As the material composition of the second region 76 of the bit body 72 may be selected to facilitate machining thereof even in the fully sintered state, threads having precise dimensions may be machined on the second region 76 of the bit body 72. In additional embodiments, the interface between the shank 20 and the bit body 72 may be substantially tapered. Furthermore, a shrink fit or a press fit may be provided between the shank 20 and the bit body 72.

Particle-matrix composite materials used in bit bodies or earth-boring rotary drill bits conventionally include particles or regions of tungsten carbide dispersed throughout a copper-based alloy matrix material. Copper alloys generally exhibit a linear coefficient of thermal expansion (CTE) of between about 16.0 μm/m° C. and 22.0 μm/m° C. (at room temperature), tungsten carbide generally exhibits a linear coefficient of thermal expansion of between about 4.0 μm/m° C. and 7.5 μm/m° C., and conventional particle-matrix composite materials comprising particles or regions of tungsten carbide dispersed throughout a copper-based alloy matrix material generally exhibit a linear coefficient of thermal expansion of about 12.0 μm/m° C. (as estimated using Turner's Equation). The graphite molds and preform elements (or displacements) used in conventional infiltration methods, however, generally exhibit a linear coefficient of thermal expansion of between about 1.2 μm/m° C. and 8.2 μm/m° C. As a result of the disparity in the coefficient of thermal expansion between the graphite molds and conventional particle-matrix composite materials, conventional particle-matrix composite bit bodies formed using infiltration processes may have significant residual stresses in the particle-matrix composite material after formation of the bit bodies. These stresses may be rather severe on areas of the bit body adjacent the graphite mold and/or preform elements (or displacements), and may lead to premature cracking in such areas (e.g., areas on or adjacent blades 30 and/or junk slots 32 (FIG. 2), areas adjacent cutter pockets 36 (FIG. 2), areas adjacent internal fluid passageways 42, etc.). Such cracks may lead to premature failure of the rotary drill bit.

Titanium and titanium-based alloy materials generally exhibit a linear coefficient of thermal expansion of between about 7.6 μm/m° C. and 9.8 μm/m° C., while titanium carbide exhibits a linear coefficient of thermal expansion of about 7.4 μm/m° C. and titanium diboride exhibits a linear coefficient of thermal expansion of about 8.2 μm/m° C. Therefore, particle-matrix composite materials that include a plurality of titanium carbide and/or titanium diboride particles dispersed throughout a titanium or titanium-based alloy matrix material may exhibit a linear coefficient of thermal expansion of between about 7.5 μm/m° C. and 9.5 μm/m° C. As a result, the particle-matrix composite materials described herein may exhibit a linear coefficient of thermal expansion that is substantially equal to, or less than about double, the linear coefficient of thermal expansion of a graphite mold (or a mold comprising any other refractory material) in which a bit body may be cast using such particle-matrix composite materials. Therefore, by using the particle-matrix composite materials described herein to form bit bodies of earth-boring rotary drill bits, the residual stresses developed in such bit bodies due to mismatch in the coefficient of thermal expansion between the materials and the molds may be reduced or eliminated, and the performance of rotary drill bits comprising such bit bodies may be enhanced relative to heretofore known drill bits.

In addition, titanium and titanium-based alloys may exhibit enhanced corrosion resistance relative to conventional copper and copper-based alloys that are used in particle-matrix composite materials for bit bodies of conventional earth-boring rotary drill bits, which may further enhance the performance of rotary drill bits comprising a bit body formed from the materials described herein relative to conventional earth-boring rotary drill bits.

The bit body 12 previously described herein and shown in FIG. 1 may be formed using methods substantially similar to any of those described herein in relation to the bit body 72 shown in FIG. 2 (including infiltration methods as well as powder pressing and sintering methods).

In the embodiment shown in FIG. 2, the bit body 72 includes two distinct regions having material compositions with an identifiable boundary or interface therebetween. In additional embodiments, the material composition of the bit body 72 may be continuously varied between regions within the bit body 72 such that no boundaries or interfaces between regions are readily identifiable. In additional embodiments, the bit body 72 may include more than two regions having material compositions, and the spatial location of the various regions having material compositions within the bit body 72 may be varied.

Figure 7:
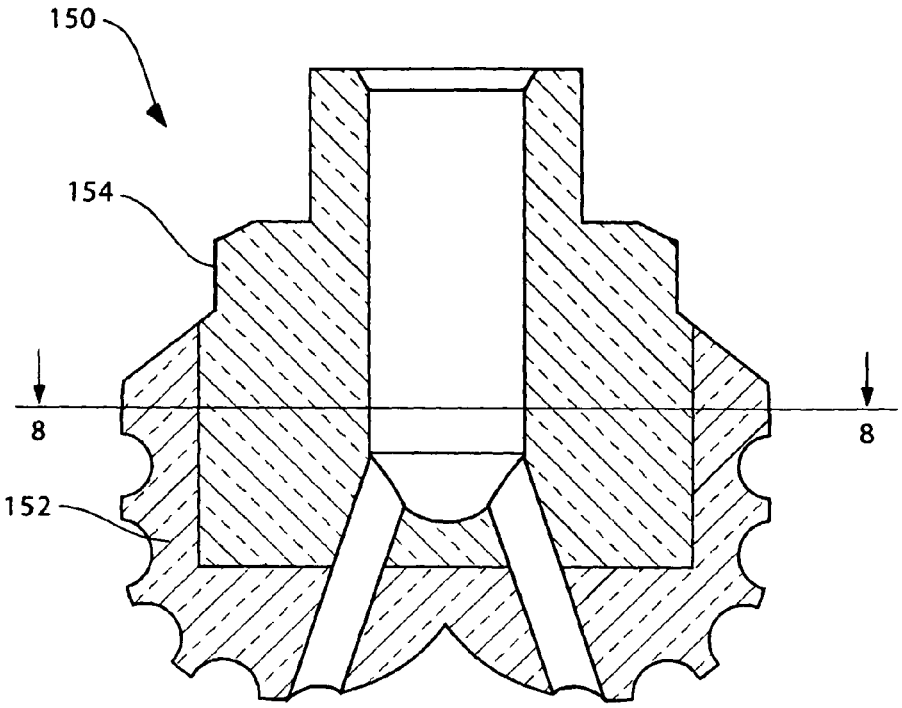
FIG. 7 is a cross-sectional side view of yet another bit body that includes a particle-matrix composite material and that embodies teachings of the present invention.
Figure 8:
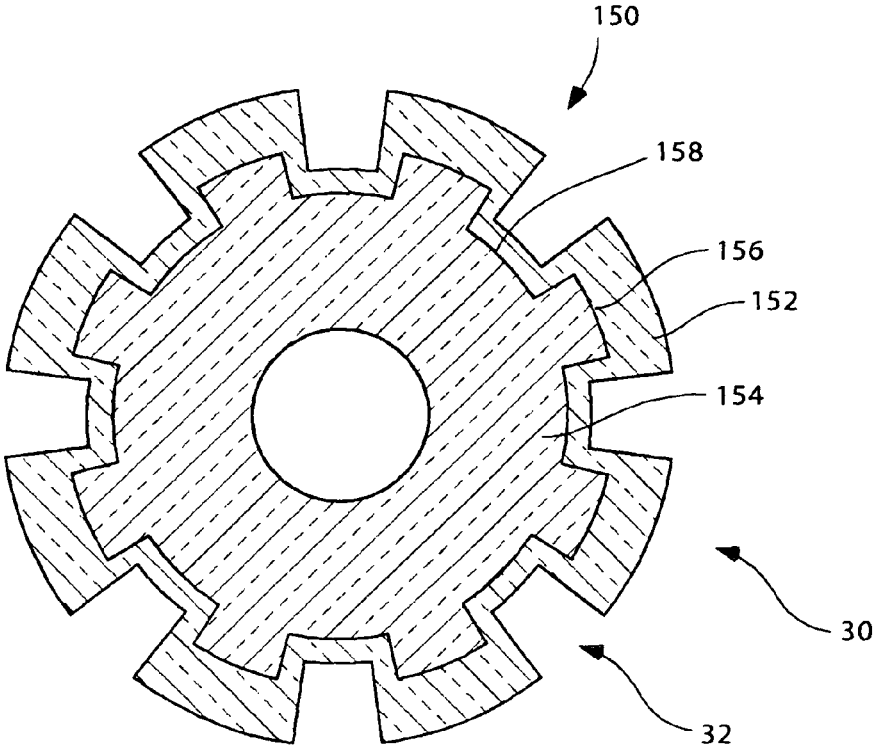
FIG. 8 is a cross-sectional view of the bit body shown in FIG. 7 taken along section line 8-8 shown therein.

FIG. 7 illustrates an additional bit body 150 that embodies teachings of the present invention. The bit body 150 includes a first region 152 and a second region 154. As best seen in the cross-sectional view of the bit body 150 shown in FIG. 8, the interface between the first region 152 and the second region 154 may generally follow the topography of the exterior surface of the first region 152. For example, the interface may include a plurality of longitudinally extending ridges 156 and depressions 158 corresponding to the blades 30 and junk slots 32 that maybe provided on and in the exterior surface of the bit body 150. In such a configuration, blades 30 on the bit body 150 may be less susceptible to fracture when a torque is applied to a drill bit comprising the bit body 150 during a drilling operation.

Figure 9:
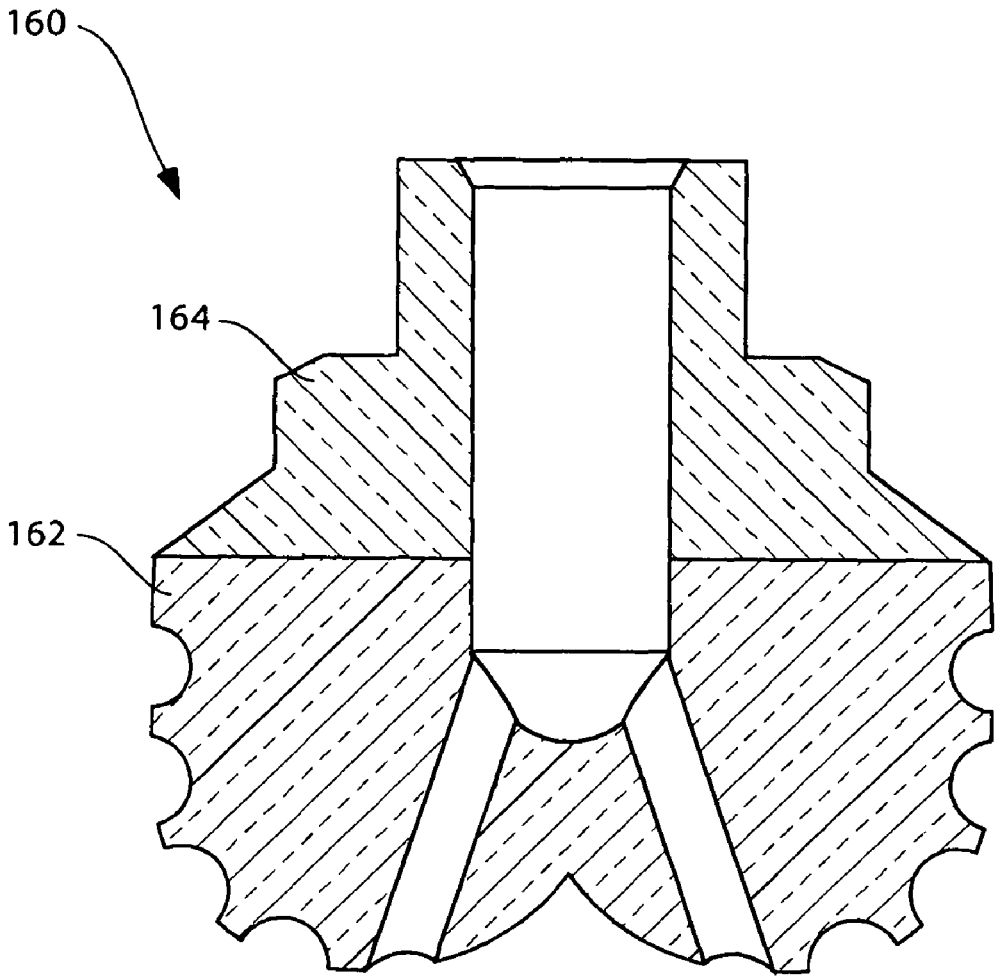
FIG. 9 is a cross-sectional side view of still another bit body that includes a particle-matrix composite material and that embodies teachings of the present invention.

FIG. 9 illustrates yet another bit body 160 that embodies teachings of the present invention. The bit body 160 also includes a first region 162 and a second region 164. The first region 162 may include a longitudinally lower region of the bit body 160, and the second region 164 may include a longitudinally upper region of the bit body 160. Furthermore, the interface between the first region 162 and the second region 164 may include a plurality of radially extending ridges and depressions (not shown), which may make the bit body 160 less susceptible to fracture along the interface when a torque is applied to a drill bit comprising the bit body 160 during a drilling operation.

While teachings of the present invention are described herein in relation to embodiments of concentric earth-boring rotary drill bits that include fixed cutters, other types of earth-boring drilling tools such as, for example, core bits, eccentric bits, bicenter bits, reamers, mills, drag bits, roller cone bits, and other such structures known in the art may embody teachings of the present invention and may be formed by methods that embody teachings of the present invention. Thus, as employed herein, the term "bits" includes and encompasses all of the foregoing structures.

While the present invention has been described herein with respect to certain preferred embodiments, those of ordinary skill in the art will recognize and appreciate that it is not so limited. Rather, many additions, deletions and modifications to the preferred embodiments may be made without departing from the scope of the invention as hereinafter claimed. In addition, features from one embodiment may be combined with features of another embodiment while still being encompassed within the scope of the invention as contemplated by the inventors. Further, the invention has utility in drill bits and core bits having different and various bit profiles as well as cutter types.

What is claimed is:

1. A rotary drill bit for drilling a subterranean formation, the drill bit comprising:

a bit body substantially comprised of a particle-matrix composite material comprising a plurality of hard phase regions dispersed throughout an α+β titanium alloy or a β titanium alloy matrix material, the hard phase regions comprising a material selected from the group consisting of titanium carbide, titanium diboride, tungsten, and titanium silicide, the hard phase regions comprising between about 20% and about 60% by volume of the particle-matrix composite material, and the titanium alloy matrix material comprising between about 80% and about 40% by volume of the particle-matrix composite material; and at least one cutting structure disposed on a face of the bit body.

2. The rotary drill bit of claim 1, further comprising a shank directly attached to a region of the bit body comprising the particle-matrix composite material.

3. The rotary drill bit of claim 2, further comprising at least one retaining member extending through at least a portion of an outer wall of the shank and abutting against at least one surface of the bit body, mechanical interference between the shank, the at least one retaining member, and the bit body at least partially securing the shank to the bit body.

4. The rotary drill bit of claim 1, wherein the titanium alloy matrix material of the composite material comprises at least about 87.5 weight percent titanium, approximately 6.0 weight percent aluminum, and approximately 4.0 weight percent vanadium.

5. The rotary drill bit of claim 4, wherein the titanium alloy matrix material further comprises at least trace amounts of at least one of tin, copper, iron, and carbon.

6. The rotary drill bit of claim 1, wherein the bit body comprises:

a first region having a first material composition, a surface of the first region being configured to carry a plurality of cutting elements for engaging an earth formation; and a second region having a second material composition differing from the first material composition.

7. The rotary drill bit of claim 6, wherein the first material composition exhibits a first hardness and the second material composition exhibits a second hardness, the second hardness being less than the first hardness.

8. The rotary drill bit of claim 6, wherein the first region comprises at least one of an α+β titanium alloy and a β titanium alloy having a hardness of greater than about 350 on the Vickers hardness scale, and wherein the second region comprises at least one of an α+β titanium alloy and a β titanium alloy having a fracture toughness of greater than about 100 MPa-$m^{1/2}$.

9. The rotary drill bit of claim 6, wherein the second region comprises a β titanium alloy.

10. The rotary drill bit of claim 9, wherein the first region comprises one of a β titanium alloy and an α+β titanium alloy.

11. The rotary drill bit of claim 6, wherein the second region comprises an α+β titanium alloy.

12. The rotary drill bit of claim 11, wherein the first region comprises one of a β titanium alloy and an α+β titanium alloy.

13. The rotary drill bit of claim 1, further comprising a layer of titanium nitride disposed on at least a portion of a surface of the rotary drill bit configured to engage a subterranean formation during drilling.

14. The rotary drill bit of claim 1, wherein the particle-matrix composite material exhibits a linear coefficient of thermal expansion at room temperature of between about 7.5 μm/m° C. and about 9.5 μm/m° C.

15. A rotary drill bit for drilling a subterranean formation, the drill bit comprising:

a bit body comprising:

a first region having a first material composition comprising a particle-matrix composite material comprising a plurality of hard phase regions dispersed throughout a an α+β titanium alloy or a β titanium alloy matrix material, the hard phase regions comprising a material selected from the group consisting of titanium carbide, titanium diboride, tungsten, and titanium silicide, the hard phase regions comprising between 20% and about 60% by volume of the particle-matrix composite material, and the titanium alloy matrix material comprising between about 80% and about 40% by volume of the particle-matrix composite material, a surface of the first region being configured to carry a plurality of cutting elements for engaging an earth formation; and a second region having a second material composition differing from the first composition and comprising a titanium or a titanium-based alloy material; and a plurality of cutting structures disposed on the surface of the first region of the bit body.

16. The rotary drill bit of claim 15, further comprising a shank directly attached to the second region of the bit body.

17. The rotary drill bit of claim 15, wherein the titanium alloy matrix material of the particle-matrix composite material of the first material composition has an average hardness of greater than about 350 on the Vickers hardness scale, and wherein the second region comprises at least one of an α+β titanium alloy and a β titanium alloy having a fracture toughness of greater than about 100MPa-$m^{1/2}$.

18. The rotary drill bit of claim 15, further comprising a layer of titanium nitride disposed on at least a portion of a surface of the rotary drill bit configured to engage a subterranean formation during drilling.

* * * * *

UNITED STATES PATENT AND TRADEMARK OFFICE

CERTIFICATE OF CORRECTION

PATENT NO. : 7,784,567 B2
APPLICATION NO. : 11/593437
DATED : August 31, 2010
INVENTOR(S) : Heeman Choe et al.

It is certified that error appears in the above-identified patent and that said Letters Patent is hereby corrected as shown below:

On the title page:

In ITEM (74) *Attorney, Agent, or Firm*: change "TraskerBritt" to --TraskBritt--

In the specification:

COLUMN 15, LINE 52, change "megapascals" to --megapascal--

In the claims:

CLAIM 15, COLUMN 22, LINE 35, change "throughout a an" to --throughout an--
CLAIM 17, COLUMN 22, LINE 60, change "100MPa-$m^{1/2}$." to --100 MPa-$m^{1/2}$.--

Signed and Sealed this
Twentieth Day of August, 2013

Teresa Stanek Rea
*Acting Director of the United States Patent and Trademark Office*